US009046831B2

(12) United States Patent
Ito et al.

(10) Patent No.: US 9,046,831 B2
(45) Date of Patent: Jun. 2, 2015

(54) FIXING DEVICE AND IMAGE FORMING APPARATUS CAPABLE OF EFFECTIVELY SUPPRESSING THERMAL ENERGY RELEASED EXTERNALLY FROM DEVICE DUE TO THERMAL CONVECTION AND HOT AIR FLOW

(75) Inventors: Takayuki Ito, Nagoya (JP); Hiroshi Mizuno, Aisai (JP); Kuniya Matsuura, Toyohashi (JP); Masayuki Satou, Toyohashi (JP); Takashi Fujiwara, Toyohashi (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 280 days.

(21) Appl. No.: 13/034,286

(22) Filed: Feb. 24, 2011

(65) Prior Publication Data

US 2011/0217054 A1 Sep. 8, 2011

(30) Foreign Application Priority Data

Mar. 5, 2010 (JP) ..... 2010-048759
Mar. 19, 2010 (JP) ..... 2010-064152
Mar. 19, 2010 (JP) ..... 2010-064153

(51) Int. Cl.
*G03G 15/20* (2006.01)
*G03G 15/00* (2006.01)
*G03G 21/20* (2006.01)

(52) U.S. Cl.
CPC ..... *G03G 15/20* (2013.01); *G03G 2215/00772* (2013.01); *G03G 21/20* (2013.01)

(58) Field of Classification Search
CPC ..... G03G 2215/00772
USPC ..... 399/94, 331, 400
See application file for complete search history.

(56) References Cited

U.S. PATENT DOCUMENTS 5,903,810 A * 5/1999 Adachi ..... 399/328
7,013,099 B2 * 3/2006 Shirakata ..... 399/92

(Continued)

FOREIGN PATENT DOCUMENTS

CN 1908825 2/2007
JP 61-147276 A 7/1986

(Continued)

OTHER PUBLICATIONS

Office Action issued by Japan Patent Office on Nov. 20, 2012 in corresponding Japanese Patent Application No. 2010-064153, and English translation thereof.

(Continued)

*Primary Examiner* — Daniel J Colilla
*Assistant Examiner* — John M Royston
(74) *Attorney, Agent, or Firm* — Buchanan Ingersoll & Rooney PC

(57) ABSTRACT

A fixing device for fixing a toner image onto a recording paper includes a heating member for heating the recording paper, a pressing member for pressing the heating member by pressure-applying contact, a casing accommodating the heating member and the pressing member, and being provided with an exit port for discharging the recording paper, and a closing unit added to the exit port for keeping a temperature of the casing. The closing unit has a rotation member, and an opposed member forming a nip region together with the rotation member.

22 Claims, 21 Drawing Sheets

(56) References Cited

U.S. PATENT DOCUMENTS

| | | | | |
|---|---|---|---|---|
| 1,908,825 | A1 | 2/2007 | KATOH et al. | |
| 7,366,432 | B2 * | 4/2008 | Kishi et al. | 399/44 |
| 2008/0050155 | A1 * | 2/2008 | Miki et al. | 399/328 |
| 2009/0238596 | A1 * | 9/2009 | Shiobara et al. | 399/69 |

FOREIGN PATENT DOCUMENTS

| | | | |
|---|---|---|---|
| JP | 7-064422 | A | 3/1995 |
| JP | 09-080968 | A | 3/1997 |
| JP | 11-282296 | A | 10/1999 |
| JP | 2001-27859 (A) | | 1/2001 |
| JP | 2004-012675 | | 1/2004 |
| JP | 2006-133318 | A | 5/2006 |
| JP | 2007-086509 | A | 4/2007 |
| JP | 2008-40437 (A) | | 2/2008 |
| JP | 2008-065146 | A | 3/2008 |
| JP | 2008-145636 | A | 6/2008 |
| JP | 2011-191706 | A | 9/2011 |

OTHER PUBLICATIONS

Office Action (Notice of Grounds of Rejection) dated Jan. 10, 2012, issued in the corresponding Japanese Patent Application No. 2010-048759, and an English Translation thereof. (9 pages).

Office Action (notice of Grounds of Rejection) dated Aug. 21, 2012, issued in corresponding Japanese Patent Application No. 2010-064153, and an English Translation thereof. (10 pages).

Office Action (Decision to Grant Patent) dated Aug. 21, 2012, issued in corresponding Japanese Patent Application No. 2010-064152, and an English Translation thereof. (6 pages).

Office Action issued on Mar. 13, 2013 by Chinese Patent Office in corresponding Chinese Patent Application No. 201110052029, and an English Translation thereof.

* cited by examiner

FIXING DEVICE AND IMAGE FORMING APPARATUS CAPABLE OF EFFECTIVELY SUPPRESSING THERMAL ENERGY RELEASED EXTERNALLY FROM DEVICE DUE TO THERMAL CONVECTION AND HOT AIR FLOW

This application is based on Japanese Patent Applications Nos. 2010-048759, 2010-064152 and 2010-064153 filed with the Japan Patent Office on Mar. 5, 2010, Mar. 19, 2010 and Mar. 19, 2010, respectively, the entire content of which is hereby incorporated by reference.

BACKGROUND OF THE INVENTION

1. Field of the Invention

The present invention relates to an image forming apparatus, and particularly to a structure of a fixing device contained in the image forming apparatus.

2. Description of the Related Art

In an image forming apparatus of an electrophotographic type, a photosensitive drum is substantially uniformly charged, and then a laser scanning unit or the like conducts exposure on the photosensitive drum to form an electrostatic latent image according to an image signal. Then, toner that is charged by a developer is supplied onto the photosensitive drum to visualize a toner image, which is transferred onto a recording paper such as a transfer paper sheet. The toner image transferred onto the recording paper is merely born on the recording paper, and is not fixed thereto. Therefore, a fixing unit arranged in the image forming apparatus applies heat and pressure for thermally welding and fixing it so that a fixed image is formed on the recording paper.

Japanese Laid-Open Patent Publication No. 2006-133318 has disclosed a structure in which a heating member containing a halogen lamp, a pressing member pressed against the heating member and a thermister sensing a temperature of the heating member are arranged in a casing as basic components of a fixing unit, respectively. In this fixing unit, the toner image that passes through a nip portion formed by the heating and pressing members pressed together is heated by heat of the heating member that is heated by heat radiated from the halogen lamp, and receives a pressure from the heating and pressing members pressed against it so that the toner image is fixed onto the recording paper. The casing is provided with an entry port for transporting the recording paper thereinto and an exit port for discharging the recording paper therefrom. The recording paper bearing the toner image is transported into the casing through the entry port, and the recording paper bearing the fixed image is transported from the casing through the exit port.

Conventionally, a configuration for preventing diffusion of heat generated by a fixing device and improving a heat retaining effect has been employed. For example, Japanese Laid-Open Patent Publication No. 2006-133318 has disclosed a structure in which openable shutter members are arranged in a sheet entry port and a sheet exit port, respectively. Japanese Laid-Open Patent Publication No. 07-064422 has disclosed a structure in which an openable shutter is arranged in a heat insulator covering a fixing roller and a pressing roller. When printing is not performed, the shutter closes to prevent external diffusion of heat from a fixing device. In a printing operation, the shutter opens to allow passing of a paper sheet.

According to the above disclosed fixing device, however, the shutter must open in the sheet transporting operation, and the heat insulation can be performed in the non-printing operation. However, in the printing operation, i.e., in the sheet transporting operation, the heat insulation cannot be performed, resulting in a problem that the heat escapes from the inside of the fixing device due to an air flow formed on a sheet surface.

SUMMARY OF THE INVENTION

An object of the invention is to overcome the above problem, and particularly to provide a fixing device and an image forming apparatus that can effectively suppress thermal energy that is externally released from a device by thermal convection and hot air flow.

According to an aspect of the invention, a fixing device for fixing a toner image onto a recording paper includes a heating member for heating the recording paper; a pressing member for pressing the heating member by pressure-applying contact; a casing accommodating the heating member and the pressing member, and being provided with an exit port for discharging the recording paper; and a closing unit added to the exit port for keeping a temperature of the casing. The closing unit has a rotation member, and an opposed member forming a nip region together with the rotation member.

Preferably, the opposed member is an opposed rotation member.

Preferably, the opposed member is a partial region of the opposed casing.

Preferably, the rotation member is formed of a member having a heat-insulating property.

Preferably, the nip region formed between the rotation member and the opposed member is formed without any gap in a region other than the recording paper during sheet passing.

Preferably, the fixing device further includes a different closing unit added to an entry port for keeping a temperature of the casing. The different closing unit has a different rotation member for taking in the recording paper, and a different opposed member for forming a different nip region together with the different rotation member.

Preferably, the fixing device further includes an openable shutter added to an entry port.

Preferably, the closing unit further has a heat-insulating member arranged between the casing and the rotation member.

Preferably, a surface temperature of the rotation member is uniformized before passing of the recording paper.

Particularly, the rotation member rotates before the passing of the recording paper.

Particularly, the fixing device further includes a drive unit for driving the rotation member. The drive unit drives the rotation member before the passing of the recording paper according to an instruction based on a number of the last printed recording papers and a time elapsed since last printing.

Particularly, the fixing device further includes first temperature sensing unit for sensing a temperature in the casing. A surface temperature of the rotation member is uniformized before the passing of the recording paper based on a result of sensing by the first temperature sensing unit.

Particularly, the fixing device further includes second temperature sensing unit for sensing a temperature of the rotation member outside the casing. The surface temperature of the rotation member is uniformized before the passing of the recording paper based on a difference between results of sensing by the first temperature sensing unit and the second temperature sensing unit.

Particularly, a rotation direction of the rotation member is changeable. The rotation direction of the rotation member is changed based on the result of sensing by the first temperature sensing unit.

Particularly, a rotation direction of the rotation member is changeable.

Particularly, the fixing device further includes a first drive transmission path for rotating and driving the rotation member in a first rotation direction; and a second drive transmission path for rotating and driving the rotation member in a second rotation direction. Change between the first and second drive transmission paths is performed according to a not-passing state and a passing state of the recording paper.

Particularly, the opposed member has a different rotation member for rotation together with the rotation member.

Preferably, a set temperature of the heating member is adjusted when a surface temperature of the rotation member is equal to or higher than a predetermined temperature.

Particularly, the fixing device further includes first temperature sensing unit for sensing the temperature of the heating member; and second temperature sensing unit for sensing the temperature of the rotation member.

Particularly, the first temperature sensing unit and the second temperature sensing unit are located in the casing and are attached to one base member.

Particularly, the set temperature of the heating member is lowered when the surface temperature of the rotation member becomes equal to or higher than a predetermined temperature.

An image forming apparatus includes image forming means for forming a toner image; and a fixing device for fixing the toner image onto a recording paper. The fixing device includes a heating member for heating the recording paper, a pressing member for pressing the heating member by pressure-applying contact, a casing accommodating the heating member and the pressing member, and being provided with an exit port for discharging the recording paper, and a closing unit added to the exit port for keeping a temperature of the casing. The closing unit has a rotation member, and an opposed member forming a nip region together with the rotation member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the invention will now be described with reference to the drawings. In the following description, the same or corresponding portions bear the same reference numbers, and description thereof is not repeated.

First Embodiment

Figure 1:
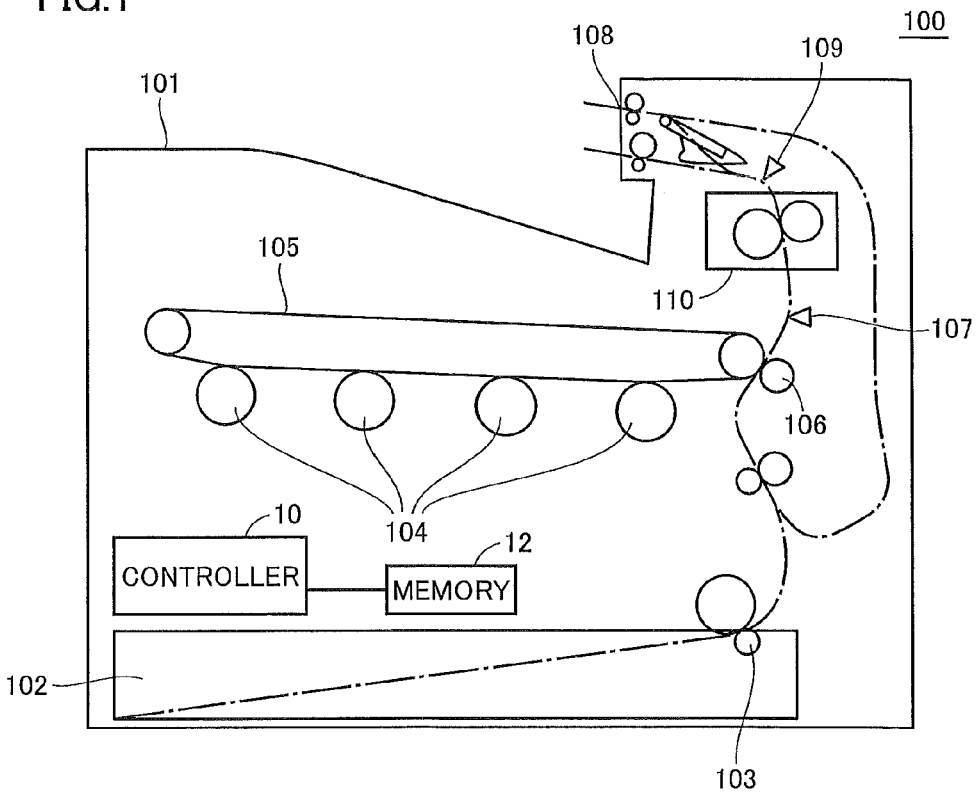
FIG. 1 is a view illustrating a structure of an image forming apparatus according to a first embodiment of the invention.

FIG. 1 is a view illustrating a structure of an image forming apparatus according to a first embodiment of the invention.

Referring to FIG. 1, an image forming apparatus 100 according to the first embodiment of the invention has an outer cover 101 covering a whole body of the apparatus, and a recording paper subjected to printing inside the apparatus body is discharged from a discharge opening 108.

For example, the apparatus body in this embodiment is a color printer of a tandem type forming color images.

Specifically, the example includes, for image formation, four rotating photoreceptors 104, an intermediate transfer belt 105 that successively layers toner images formed successively in respective transfer positions on photoreceptors 104 and transfers them, and a transfer roller 106 arranged in a transfer position that is set around a transportation plane of intermediate transfer belt 105. A sheet feed roller 103 transports the recording papers stored in a sheet cassette 102 to the transfer position. Although not shown, sheet cassette 102 is provided with a sensor for sensing presence or absence of the recording paper. When sheet cassette 102 is not set or there is no recording paper, a display panel (not shown) or the like informs a user of such a fact.

Image forming apparatus 100 forms an electrostatic latent image on photoreceptor 104 based on image data to be printed on the recording paper. The electrostatic latent images formed on photoreceptor 104 are visualized by development to form toner images, which are successively layered by intermediate transfer belt 105. The toner images that were electrostatically transferred onto intermediate transfer belt 105 and were combined together are electrostatically and collectively transferred onto the recording paper in the transfer position by electrostatic attraction from transfer roller 106. The transfer member (recording paper) subjected to the transfer passes through a fixing device 110 to fix the image by heat and pressure applied thereto. This step completes the image formation. Then, the recording paper is discharged from discharge opening 108.

Further, the apparatus includes a document sensor 107 for sensing the recording paper that is transported between fixing device 110 and transfer roller 106, and a document sensor 109 for sensing the recording paper that is transported between fixing device 110 and discharge opening 108. Document sensor 107 senses the passing of a forward end of the recording paper that passed over transfer roller 106. Document sensor 109 senses the passing of a rear end of the recording paper that passed through fixing device 110. In this embodiment, a controller 10 is shown as control means for entirely controlling image forming apparatus 100. Controller 10 reads an application program stored in a memory 12, and thereby implements a flow to be described later.

Figure 2:
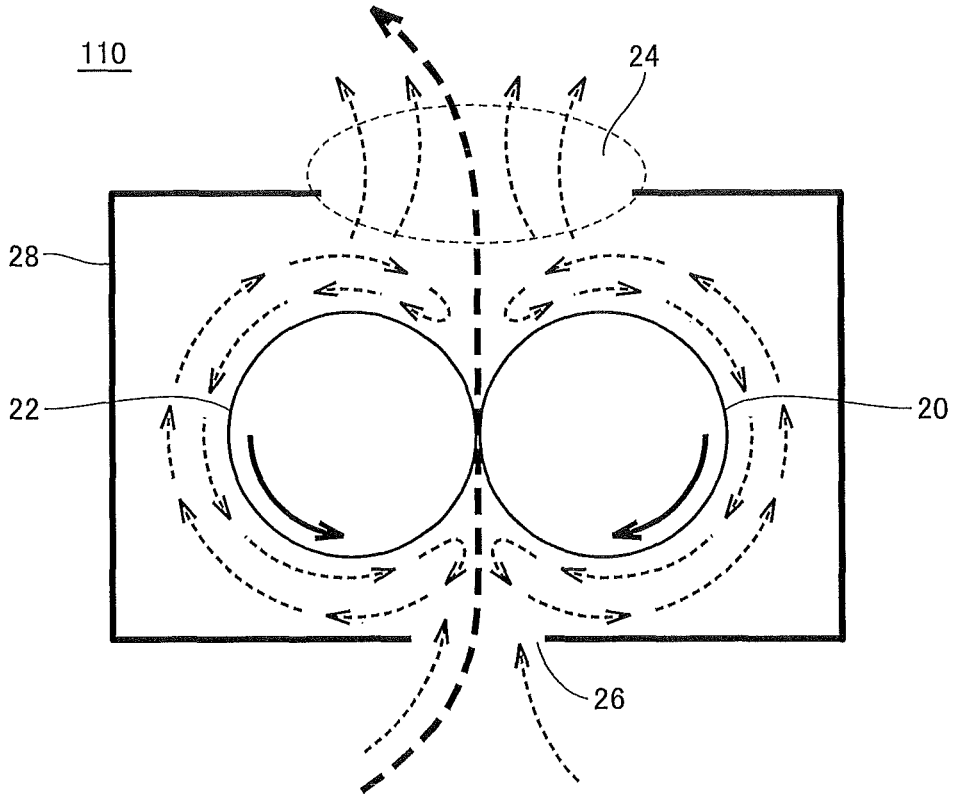
FIG. 2 is a view illustrating thermal convection and hot air flow in a fixing device 110 according to the first embodiment of the invention.

FIG. 2 is a view illustrating thermal convection and hot air flow in fixing device 110 according to the first embodiment of the invention.

Referring to FIG. 2, there is shown a case where fixing device 110 includes a casing 28, a heating roller (heating member) 22 and a pressing roller (pressing member) 20. Casing 28 has an entry port 26 for taking in the recording paper and an exit port 24 for discharging the recording paper.

As shown therein, an upward air flow caused by heat as well as thermal convection caused by rotation are present around heating and pressing rollers 22 and 20. Further, as the recording paper is transported from entry port 26, a hot air flow occurs in the discharging direction of the recording paper. These are released externally from fixing device 110 through the exit port of casing 28.

In the first embodiment of the invention, therefore, a closing mechanism for closing the exit port of casing 28 is arranged in the exit port.

Figure 3:
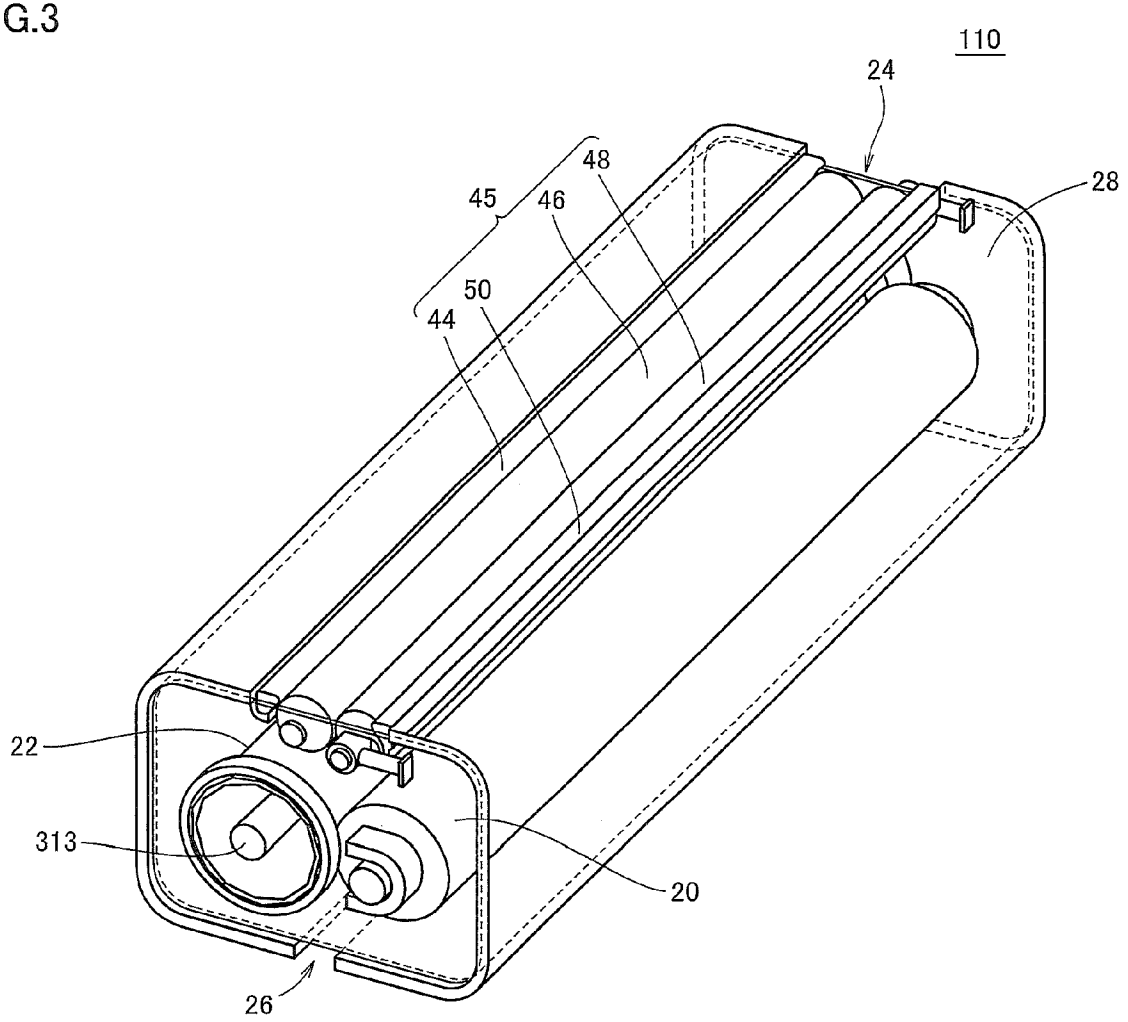
FIG. 3 is a perspective view of fixing device 110 according to the first embodiment of the invention.

FIG. 3 is a perspective view of fixing device 110 according to the first embodiment of the invention.

Referring to FIG. 3, fixing device 110 is substantially entirely covered by casing 28, is provided at an upper side (downstream in the transporting direction of the document) of casing 28 with exit port 24, and is provided at a lower portion on the opposite side (upstream in the transporting direction of the document) with entry port 26.

Casing 28 is provided with heating roller 22 internally having a halogen lamp 313 as well as pressing roller 20.

The recording paper that is transported into entry port 26 in the lower portion of casing 28 is subjected to the heating and pressing by heating and pressing rollers 22 and 20 for fixing the toner image, and then is discharged from exit port 24.

The first embodiment of the invention employs a closing mechanism 45 added to exit port 24 for closing the exit port.

More specifically, closing mechanism 45 includes heat insulators 44 and 50 as well as heat-insulating rotation rollers 46 and 48. Heat-insulating rotation rollers 46 and 48 are pressed against each other to form a nip region. The nip region is formed such that a space may not be formed in a region other than the recording paper when the recording paper is passing therethrough.

Heat-insulating rotation rollers 46 and 48 rotate to discharge through exit port 24 the recording paper bearing the toner image that is fixed by heating and pressing rollers 22 and 20.

Thus, heat-insulating rotation rollers 46 and 48 form the nip region, and therefore can suppress external releasing of thermal energy through the exit port when the recording paper is externally discharged according to the rotation of heat-insulating rotation rollers 46 and 48.

Thereby, the heat that was generated in the heating roller and was not used for melting the toner in the printing and non-printing operations can be prevented from being externally released from the casing of fixing device 110. Further, the prevention of releasing of the thermal energy can promote the temperature rising in fixing device 110. This results in such effects that a warm-up time can be reduced, and temperature lowering of the heating roller can be restrained, so that improvement in energy efficiency can achieve energy saving as well as reduction in running cost.

Figure 4:
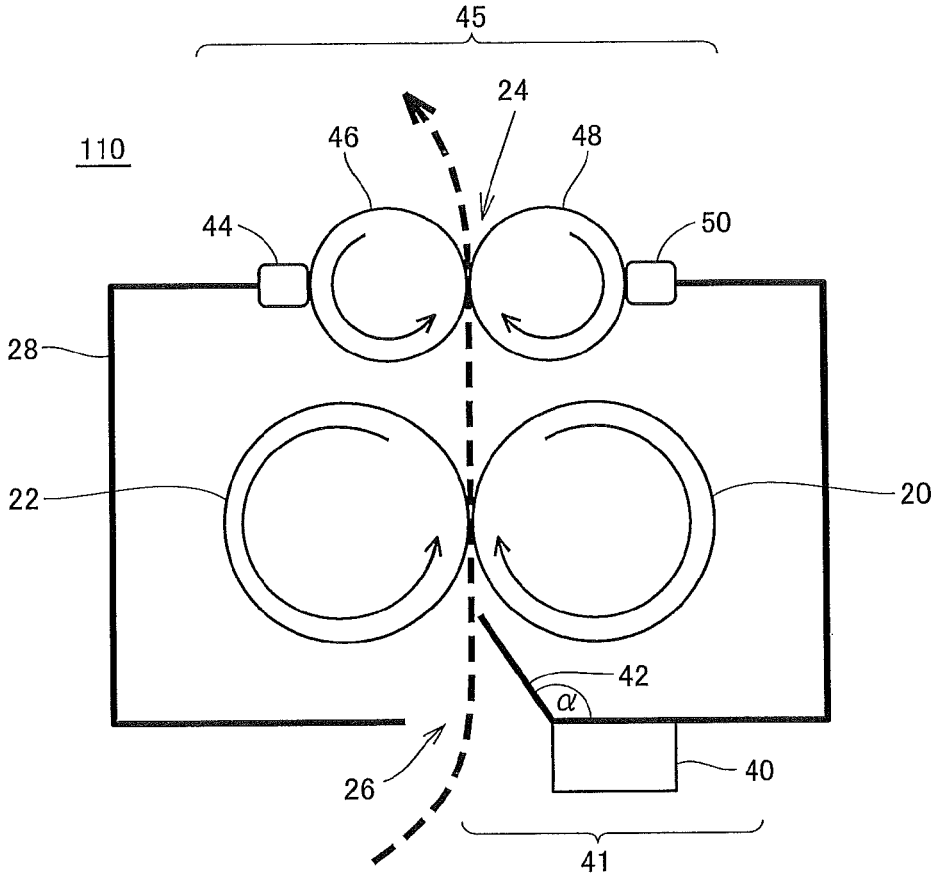
FIG. 4 is a cross section of fixing device 110 according to the first embodiment of the invention.

FIG. 4 is a cross section of fixing device 110 according to the first embodiment of the invention.

Referring to FIG. 4, closing mechanism 45 arranged in exit port 24 and a closing mechanism 41 arranged in entry port 26 are shown.

Closing mechanism 45 further includes heat insulators 44 and 50 made of sponge or the like and arranged in regions where portions of heat-insulating rotation rollers 46 and 48 remote from the nip region of heat-insulating rotation rollers 46 and 48 are in contact with casing 28, respectively. Heat insulator 44 is in contact with heat-insulating rotation roller 46, and heat insulator 50 is in contact with heat-insulating rotation roller 48.

Since heat-insulating rotation rollers 46 and 48 are in contact with casing 28 through heat insulators 44 and 50, respectively, heat insulators 44 and 50 can further suppress the releasing of the heat energy through exit port 24 of casing 28, and further can prevent wearing of heat-insulating rotation rollers 46 and 48. In this embodiment, the structure provided with heat insulators 44 and 50 has been primarily described. However, the structure may not employ them.

Closing mechanism 41 includes a shutter 42 that can close and open entry port 26, and also includes a drive mechanism 40 for driving shutter 42.

In the printing operation, drive mechanism 40 rotates shutter 42 closing entry port 26 of the recording paper and moves it into the casing. Specifically, it rotates shutter 42 to form a predetermined angle $\alpha$ with respect to casing 28. Shutter 42 that is rotated by drive mechanism 40 to form predetermined angle $\alpha$ functions as a transport guide member guiding the record sheet to the nip region between heating and pressing rollers 22 and 20.

According to the above structure, shutter 42 closes entry port 26 during the state other than the printing, and thereby can increase a heat retaining effect so that the warm-up time can be further reduced.

(First Modification of the First Embodiment)

Figure 5:
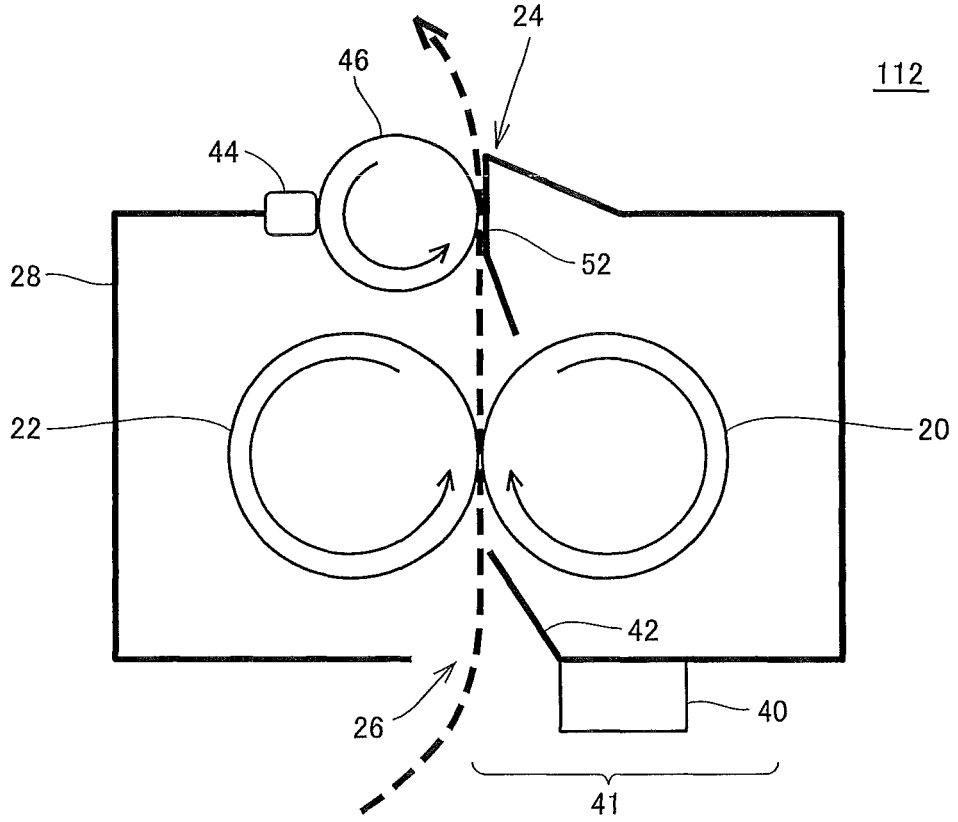
FIG. 5 is a cross section of a fixing device 112 according to a first modification of the first embodiment of the invention.

FIG. 5 is a cross section of a fixing device 112 according to a first modification of the first embodiment of the invention.

Referring to FIG. 5, fixing device 112 according to the first modification of the first embodiment of the invention differs from fixing device 110 illustrated in FIG. 4 in that heat-insulating rotation roller 48 and heat insulator 50 are not arranged, and heat-insulating rotation roller 46 is in direct contact with a partial region 52 of casing 28. Other structures are the same as those shown in FIG. 4, and therefore description thereof is not repeated.

Heat-insulating rotation roller 46 is pressed against partial region 52 of casing 28 to form the nip region. Partial region 52 of casing 28 functions as a guide member externally transporting from casing 28 the recording paper that is transported from heating and pressing rollers 22 and 20.

In the above structure, exit port 24 is likewise closed by partial region 52 of casing 28 and heat-insulating rotation roller 46, and therefore the structure can achieve substantially the same effect as that of the embodiment. Further, the structure does not employ heat-insulating rotation roller 48 and heat insulator 50, and therefore can reduce the number of the parts.

(Second Modification of the First Embodiment)

Figure 6:
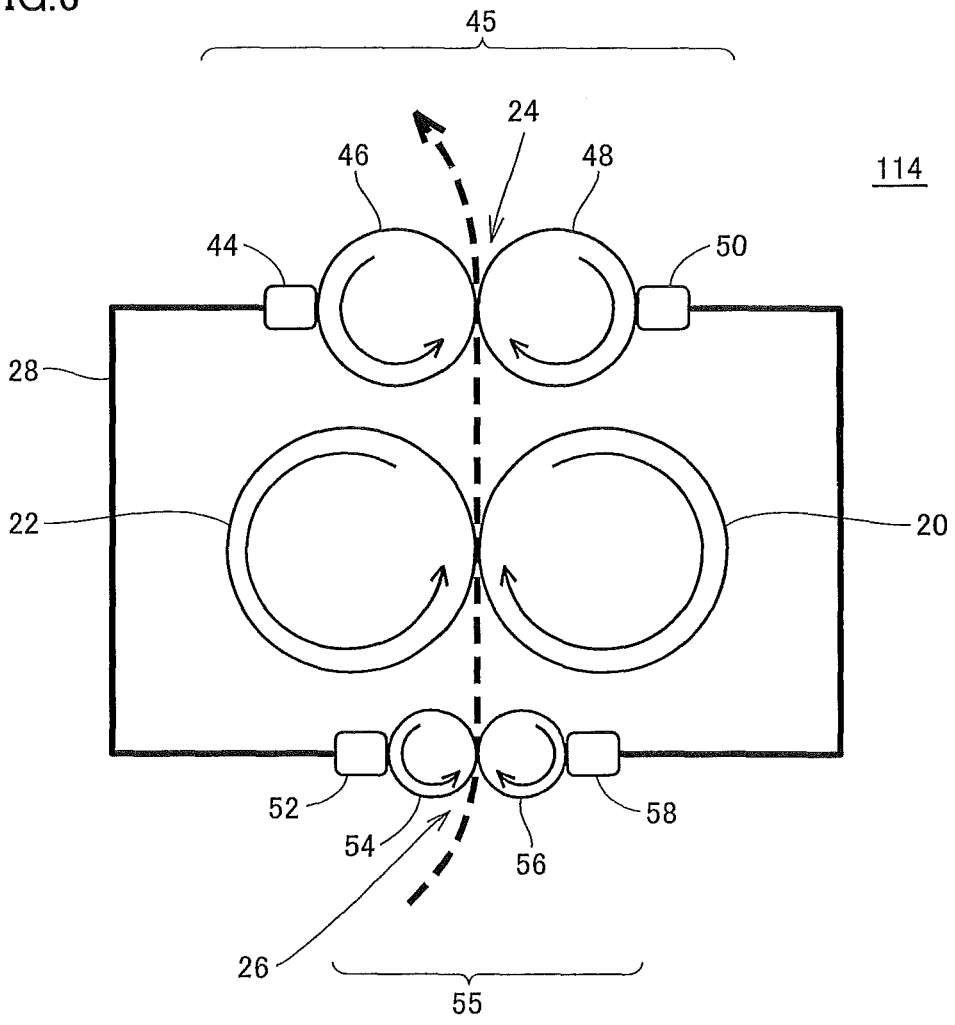
FIG. 6 is a cross section of a fixing device 114 according to a second modification of the first embodiment of the invention.

FIG. 6 is a cross section of a fixing device 114 according to a second modification of the first embodiment of the invention.

Referring to FIG. 6, fixing device 114 according to the second modification of the first embodiment of the invention differs from fixing device 110 illustrated in FIG. 4 in that closing mechanism 41 is replaced with a closing mechanism 55.

Closing mechanism 55 includes heat insulators 52 and 58, and heat-insulating rotation rollers 54 and 56. Heat-insulating rotation rollers 54 and 56 are pressed together to form a nip region. The nip region is formed such that a space is not formed in a region other than the recording paper during passing of the recording paper.

Heat-insulating rotation rollers 54 and 56 rotate to take in the recording paper through entry port 26.

Therefore, heat-insulating rotation rollers 54 and 56 form the nip region, and therefore can eliminate a gap in the entry port to suppress external releasing of the heat when the recording paper is taken in according to the rotation of heat-insulating rotation rollers 54 and 56.

Thereby, the temperature of fixing device 110 can be raised further quickly so that the warm-up time can be reduced and the temperature lowering of the heating roller can be restrained. Therefore, the improvement in energy efficiency can achieve energy saving as well as reduction in running cost.

(Third Modification of the First Embodiment)

The description has been given on the case where the fixing device is configured to transport the recording paper in the vertical direction that is the downward direction of the sheet transporting direction. In some cases, however, an image forming apparatus may transport the recording paper downward in the sheet transporting direction by transporting it not in the vertical direction but in another direction such as a horizontal direction.

Figure 7:
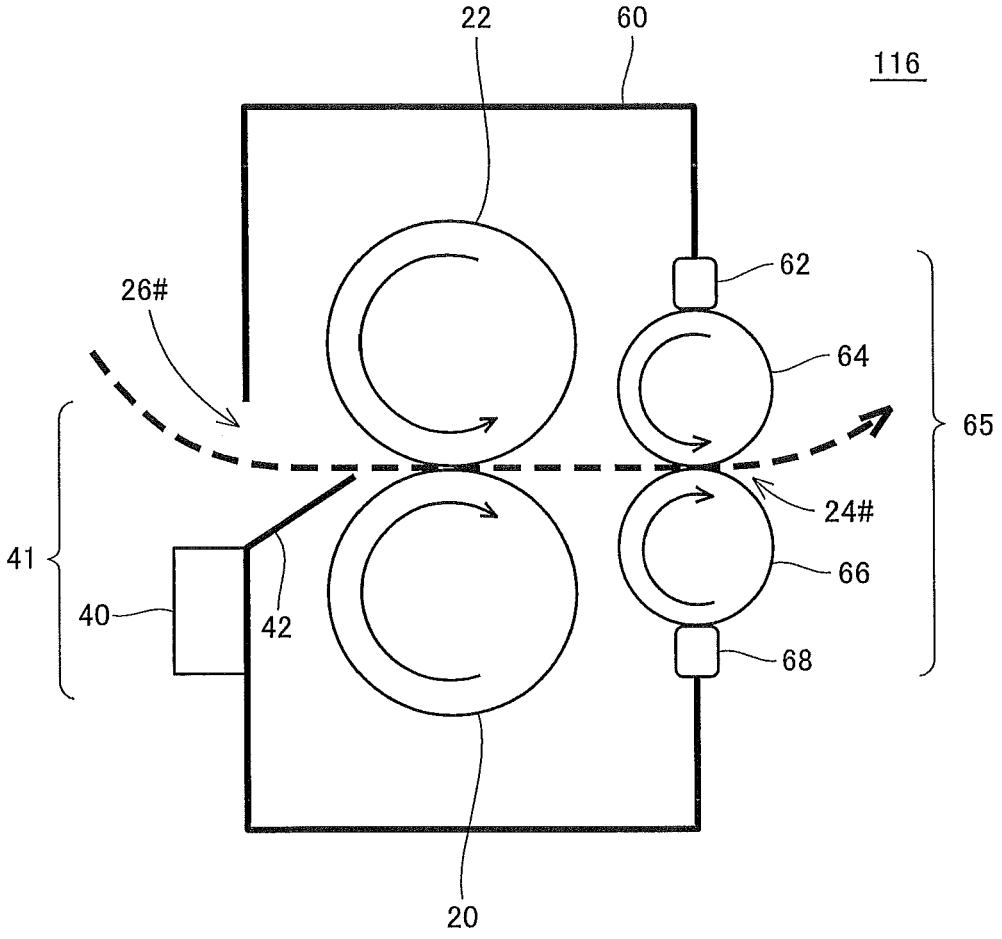
FIG. 7 is a cross section of a fixing device 116 according to a third modification of the first embodiment of the invention.

FIG. 7 is a cross section of a fixing device 116 according to a third modification of the first embodiment of the invention.

Referring to FIG. 7, fixing device 116 according to the third modification of the first embodiment of the invention is provided with a casing 60, and is also provided with an exit port 24# located on the right side (downstream side in the document transporting direction) as well as an entry port 26# located on the opposite, i.e., the left side (upstream side in the transporting direction of the document).

A closing mechanism 65 arranged in exit port 24# and a closing mechanism 41 arranged in entry port 26# are also shown.

Closing mechanism 65 includes heat-insulating rotation rollers 64 and 66 as well as heat insulators 62 and 68, and have substantially the same structure except for the reference numbers as the structure of closing mechanism 45.

Closing mechanism 41 is the same as that already described.

Therefore, heat-insulating rotation rollers 64 and 66 form the nip region, and therefore can suppress external releasing of the heat through the exit port when the recording paper is externally transported according to the rotation of heat-insulating rotation rollers 64 and 66.

Thereby, fixing device 116 that horizontally transports the recording paper can likewise promote the temperature rising in fixing device 116, and therefore can achieve substantially the same effect as the first embodiment.

Although not shown, the fixing device horizontally transporting the recording paper can likewise employ the structure of the first modification.

(Fourth Modification of the First Embodiment)

Figure 8:
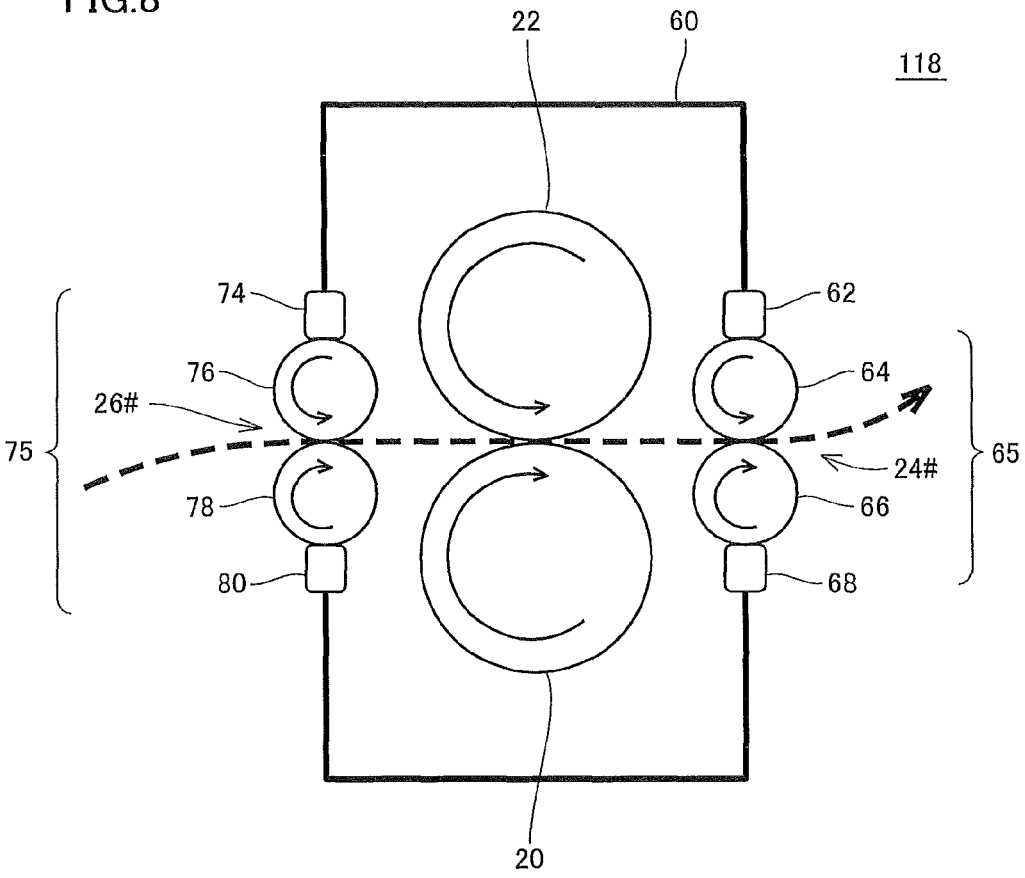
FIG. 8 is a cross section of a fixing device 118 according to a fourth modification of the first embodiment of the invention.

FIG. 8 is a cross section of a fixing device 118 according to a fourth modification of the first embodiment of the invention.

Referring to FIG. 8, fixing device 118 according to the fourth modification of the first embodiment of the invention differs from fixing device 116 in FIG. 7 in that it is provided at entry port 26# with a closing mechanism 75 in place of closing mechanism 41.

Closing mechanism 75 includes heat-insulators 74 and 80 as well as heat-insulating rotation rollers 76 and 78. Heat-insulating rotation rollers 76 and 78 are pressed together to form a nip region. The nip region is formed such that a gap is not formed in a region other than the recording paper when the recording paper is passing.

Heat-insulating rotation rollers 76 and 78 rotate to transport the recording paper through entry port 26#.

Since heat-insulating rotation rollers 76 and 78 form the nip region, these can eliminate the gap in the entry port when the recording paper is taken in according to the rotation of heat-insulating rotation rollers 76 and 78, and therefore can suppress external releasing of the heat.

This can further promote the rising of the temperature in fixing device 118, and therefore offers the effect of reducing the warm-up time and restraining the temperature lowering of the heating roller so that the energy saving and the reduction of the running cost can be achieved owing to the improvement in energy efficiency.

Second Embodiment

The first embodiment has been described in connection with the configuration that increases the heat retaining effect in fixing device 110 and thereby further reduces the warm-up time.

A second embodiment of the invention will be described in connection with a configuration that keeps good image quality.

Figure 9:
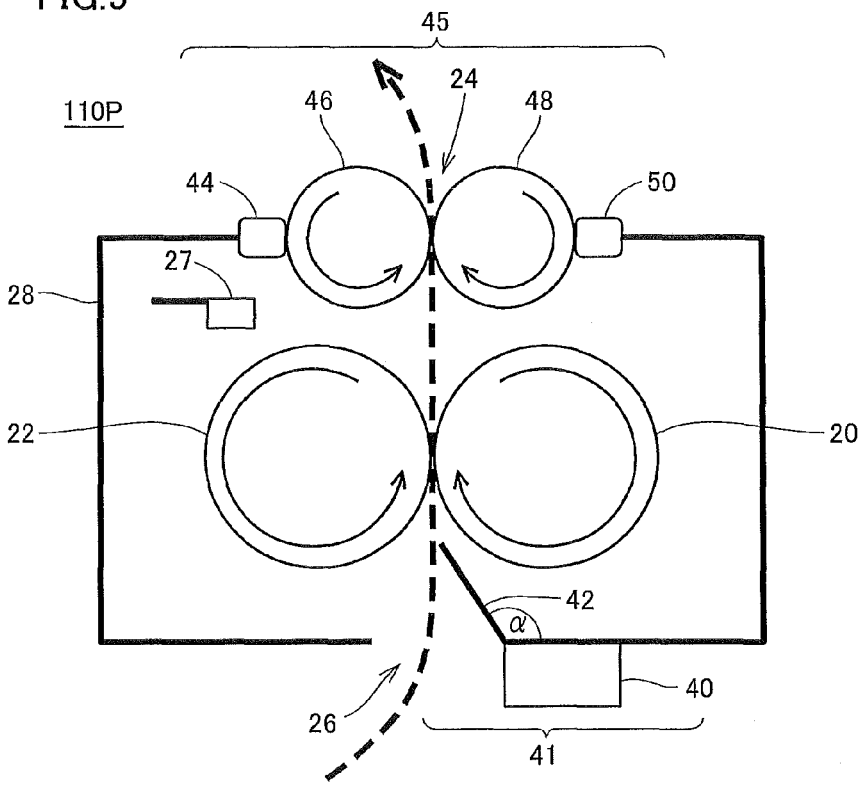
FIG. 9 is a cross section of a fixing device 110P according to a second embodiment of the invention.

FIG. 9 is a cross section of a fixing device 110P according to the second embodiment of the invention.

Referring to FIG. 9, fixing device 110P according to the second embodiment of the invention differs from fixing device 110 in that it includes temperature sensing unit 27 of a non-contact type for sensing an internal temperature of fixing device 110P. Other structures are substantially the same, and therefore description thereof is not repeated. Although not shown, temperature sensing unit for sensing the temperature of heating roller 22 is employed. The on/off of the halogen lamp is controlled based on a result of the temperature sensing by the temperature sensing unit so that the temperature of heating roller 22 is adjusted. The temperature sensing unit is not particularly restricted, and may be either of the non-contact type or a contact type such as a thermister.

Figure 10:
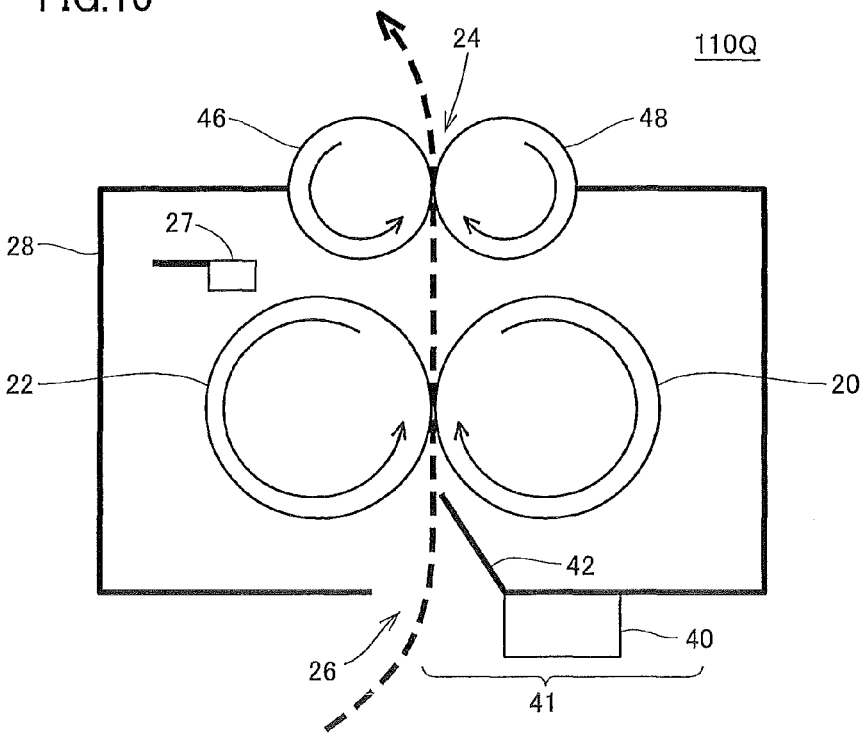
FIG. 10 is a cross section of another fixing device 110Q according to the second embodiment of the invention.

FIG. 10 is a cross section of another fixing device 110Q according to the second embodiment of the invention.

As shown in FIG. 10, closing mechanism 45 may have a structure not employing heat insulators 44 and 50.

Figure 11:
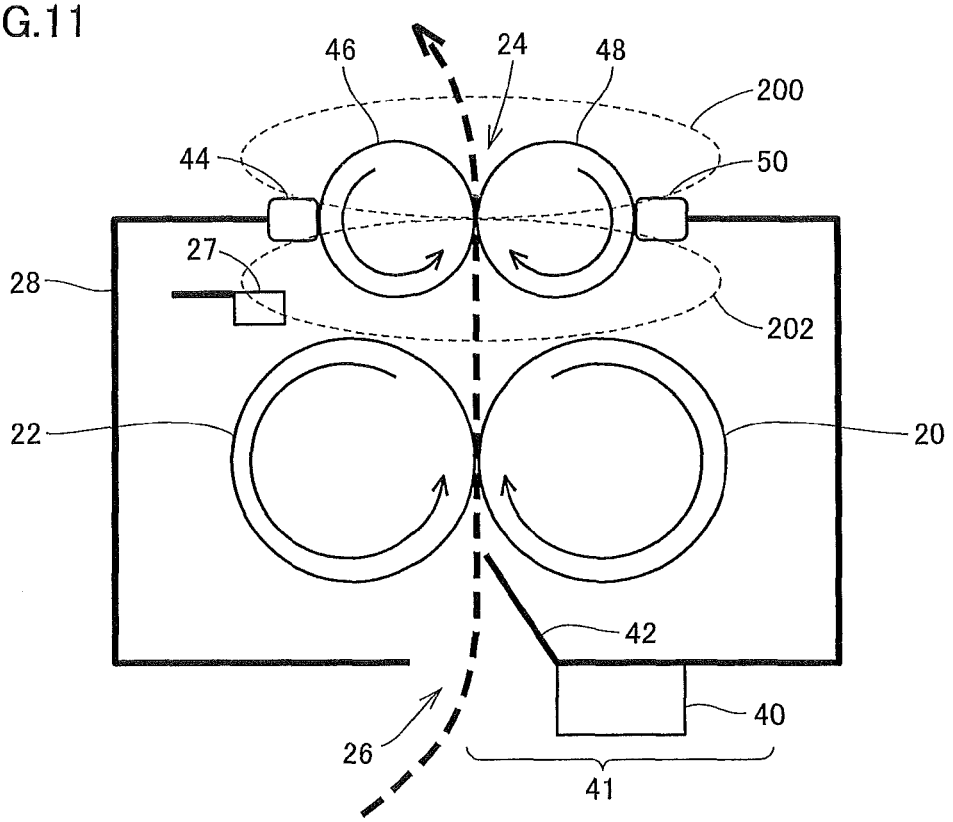
FIG. 11 is a view illustrating a surface temperature of a heat-insulating rotation roller according to the second embodiment of the invention.

FIG. 11 is a view illustrating a surface temperature of the heat-insulating rotation roller according to the second embodiment of the invention.

Referring to FIG. 11, a region 202 of heat-insulating rotation rollers 46 and 48 facing to the interior of casing 28 is shown, and also a region 200 facing to the exterior of casing 28 is shown.

As described before, heat-insulating rotation rollers 46 and 48 suppresses the external releasing of the heat from casing 28. Therefore, the temperature of the air inside casing 28 may rise during warm-up, standby or the like, and the temperature in region 202 of heat-insulating rotation rollers 46 and 48 may exceed the temperature in region 200. Thus, a temperature difference occurs between the regions 200 and 202 of heat-insulating rotation rollers 46 and 48.

When the recording paper that passed between heating and pressing rollers 22 and 20 passes between heat-insulating rotation rollers 46 and 48 while the above temperature difference is present, image noises such as irregularities in gloss may affect the image quality due to a difference in surface temperature between heat-insulating rotation rollers 46 and 48.

Therefore, fixing device 110P according to the second embodiment of the invention suppresses a temperature difference that may occur between regions 200 and 202 of heat-insulating rotation rollers 46 and 48 during the warm-up, standby or the like. Specifically, the rotation of heat-insulating rotation rollers 46 and 48 uniformizes the surface temperature.

Figure 12:
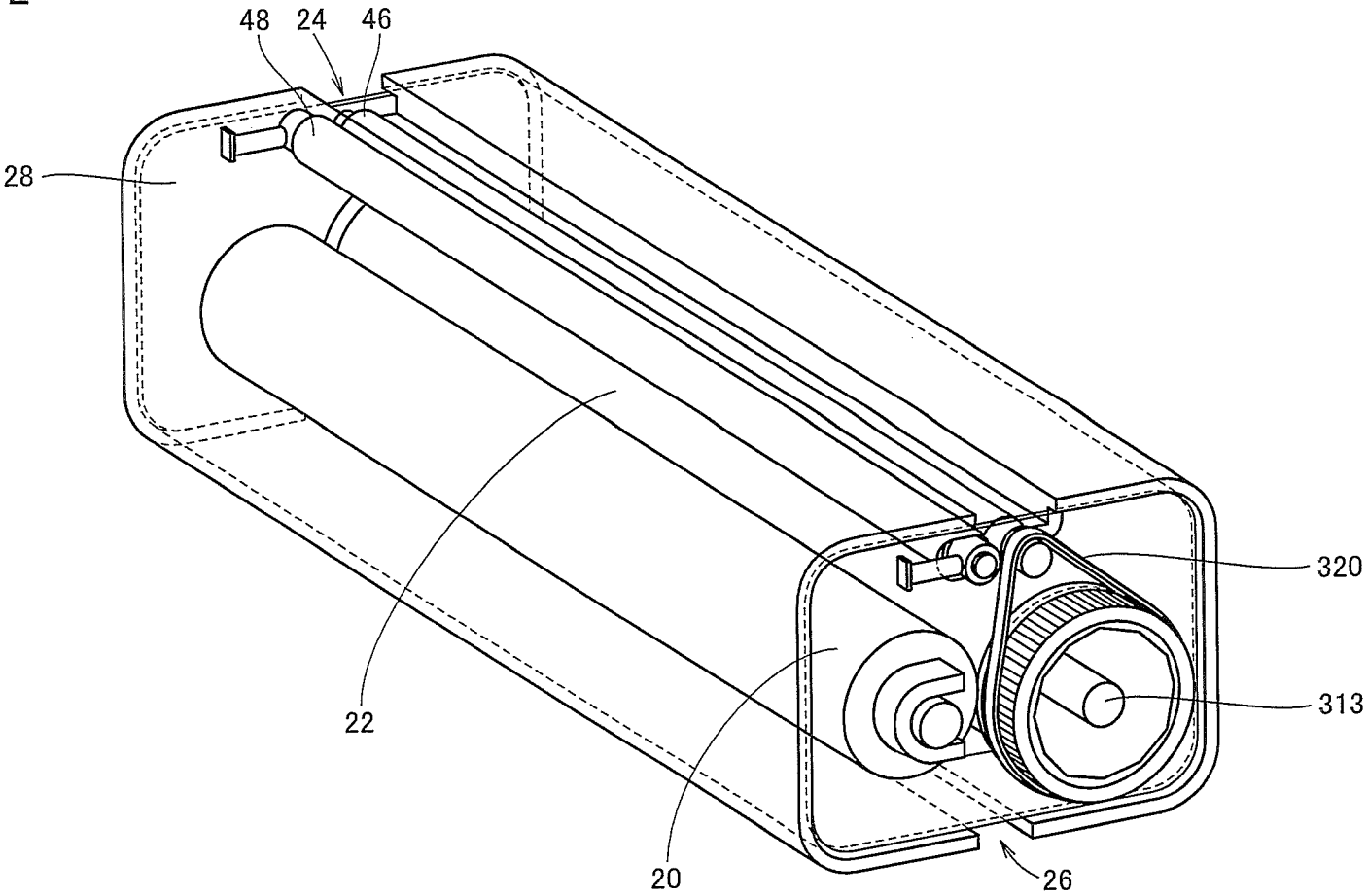
FIG. 12 is another perspective view of fixing device 110P according to the second embodiment of the invention.

FIG. 12 is another perspective view of fixing device 110P according to the second embodiment of the invention.

Referring to FIG. 12, the view is substantially the same as the perspective view of fixing device 110 in FIG. 3 viewed form the rear side thereof, and there is shown a case where heating roller 22 and heat-insulating rotation roller 46 are coupled by a coupling belt 320. In this structure, heat-insulating rotation roller 46 coupled by coupling belt 320 rotates according to the rotation of heating roller 22. The structure of the drive system driving the heat-insulating rotation roller can be simple.

Pressing roller 20 is configured to be driven by rotation of heating roller 22. Heat-insulating rotation roller 48 is driven by heat-insulating rotation roller 46.

In the above structure, heat-insulating rotation rollers 46 and 48 rotate according to the rotation of heating roller 22.

Therefore, when the recording paper passes between heating roller 22 and pressing roller 20, heat-insulating rotation rollers 46 and 48 rotate according to the rotation of heating and pressing rollers 22 and 20. Therefore, the temperature difference that may occur between regions 200 and 202 of heat-insulating rotation rollers 46 and 48 is suppressed before the sheet passes between heat-insulating rotation rollers 46 and 48. Thus, by uniformizing the surface temperature, it is possible to suppress the image noise such as irregularities in gloss, and to keep good image quality.

(First Modification of the Second Embodiment)

The second embodiment has been described in connection with the case where heat-insulating rotation roller 46 rotates in synchronization with heating roller 22. However, the drive of heating roller 22 and heat-insulating rotation roller 46 may be controlled by different drive systems, respectively.

The different drive systems allow independent control of the rotation of heat-insulating rotation roller 46.

Figure 13B:
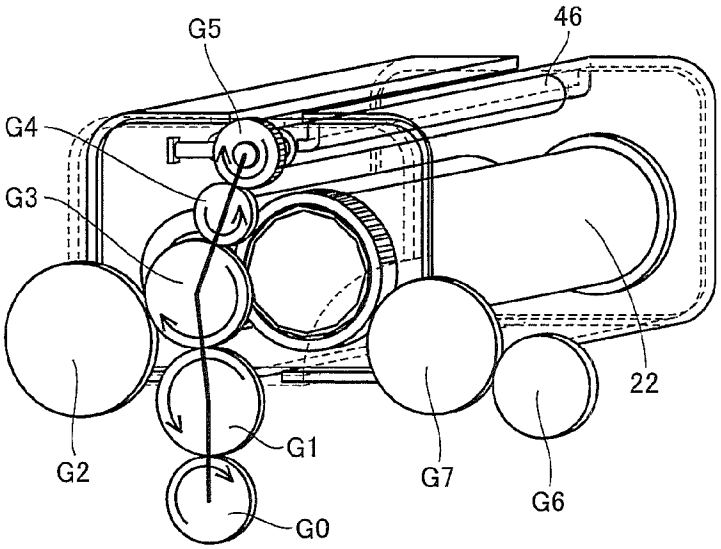
FIGS. 13A and 13B are views illustrating respective drive systems of a heating roller 22 and a heat-insulating rotation roller 46 according to a first modification of the second embodiment of the invention.
Figure 13A:
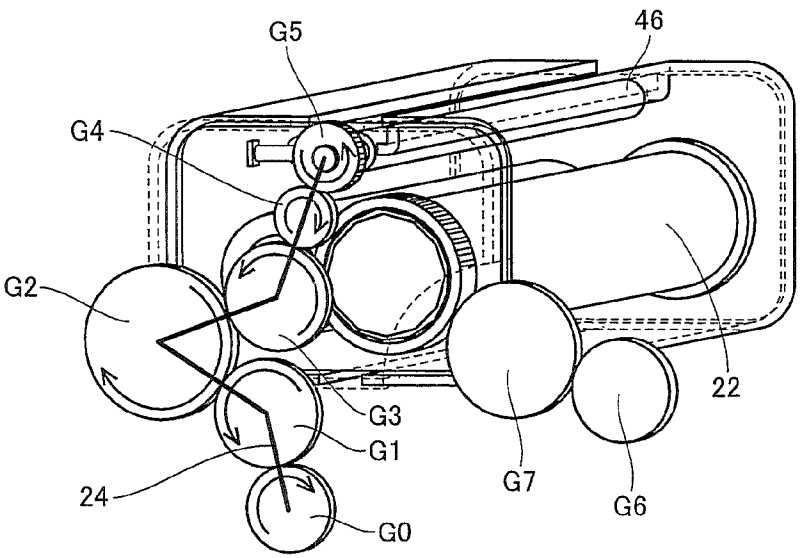

FIGS. 13A and 13B are views illustrating respective drive systems of heating roller 22 and heat-insulating rotation roller 46 according to a first modification of the second embodiment of the invention.

Referring to FIG. 13A, there is shown a case where a plurality of gears G0-G5 driving heat-insulating rotation roller 46 as well as a plurality of gears G6 and G7 driving heating roller 22 are employed.

Each of gears G0-G5 is coupled to the neighboring gear(s) to transmit the drive of gear G0 so that gear G5 rotates. Gear G5 is coupled to a rotation shaft of heat-insulating rotation roller 46. Thus, heat-insulating rotation roller 46 rotates in the rotation direction of gear G5. Heat-insulating rotation roller 48 is driven according to the rotation of heat-insulating rotation roller 46.

FIG. 13A shows the case where heat-insulating rotation rollers 46 and 48 rotate in such a direction that the recording paper passed between heat-insulating rotation rollers 46 and 48 is externally transported from fixing device 110P.

Drive of a gear G6 is transmitted to heating roller 22 so that heating roller 22 rotates. Pressing roller 20 is driven to rotate by heating roller 22.

A motor (not shown) rotates according to an instruction provided from controller 10 so that gear G0 connected thereto rotates.

Referring to FIG. 13B, there is shown a case where the position of gear G1 is adjusted by a lever (not shown). Specifically, it shows a case where gear G1 is disengaged from gear G2, is located between gears G0 and G3 and is coupled thereto. Therefore, the drive of gear G0 is transmitted in the order of gears G1, G3, G4 and G5. In this structure, the number of the gears coupled together is adjusted so that gear G2 may not be used, and this structure reverses the rotation direction. Thus, as shown in FIG. 13B, heat-insulating rotation roller 46 rotates in the direction opposite to that in FIG. 13A.

According to the instruction from controller 10, the motor (not shown) rotates to rotate gear G0 coupled thereto, and the lever (not shown) adjusts the position of gear G1 according to the instruction provided from controller 10.

This system can change the path of the drive transmission, and thereby can control the rotation direction of heat-insulating rotation roller 46.

Figure 14:
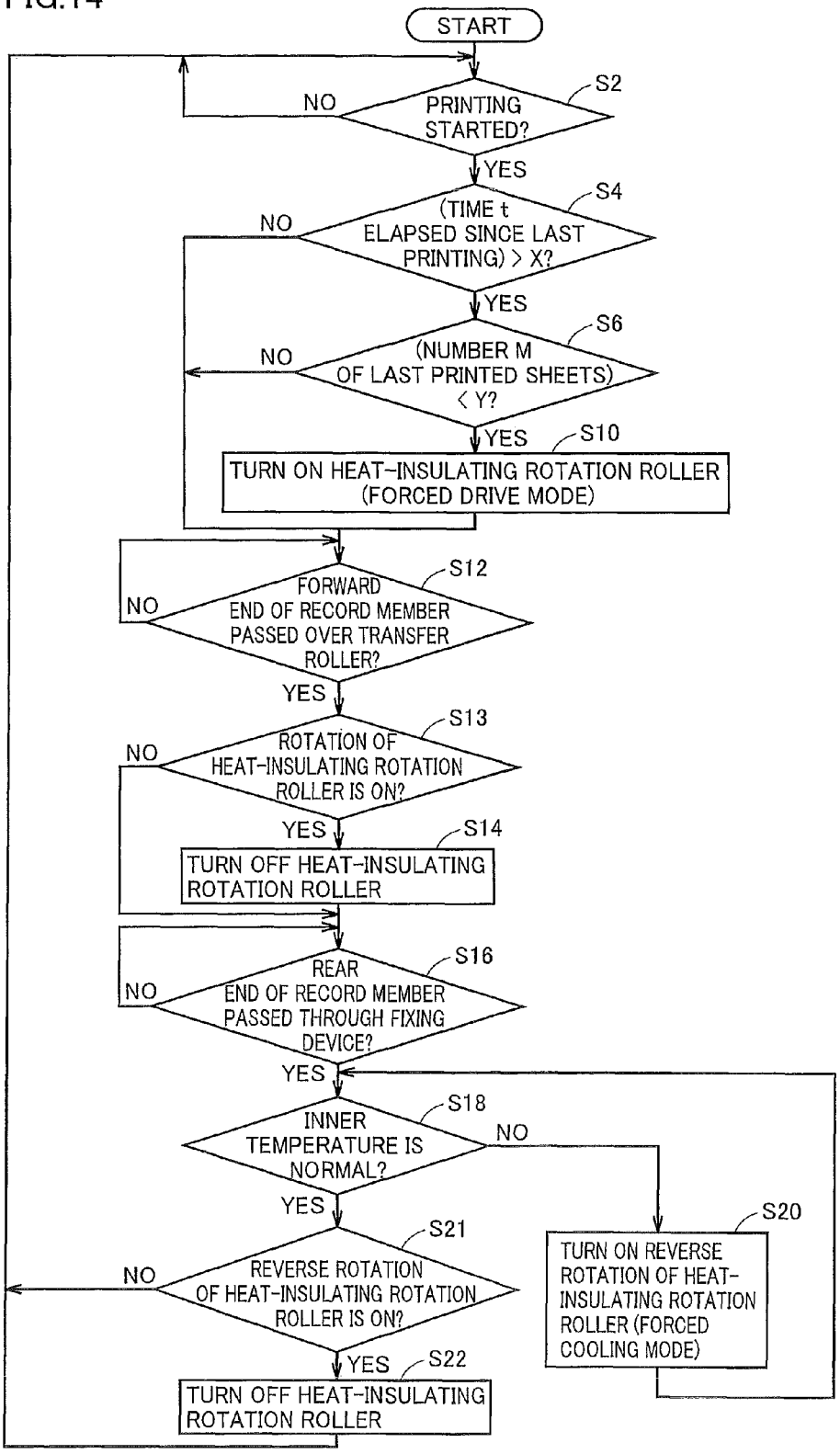
FIG. 14 is a flowchart illustrating a drive sequence of heat-insulating rotation roller 46 according to the first modification of the second embodiment of the invention.

FIG. 14 is a flowchart illustrating a drive sequence of heat-insulating rotation roller 46 according to the first modification of the second embodiment of the invention.

This drive sequence is implemented by controller 10 reading software programs stored in memory 12.

Referring to FIG. 14, controller 10 first determines whether printing started or not (step S2). Specifically, it determines whether a command for printing is received or not.

When controller 10 determines that the printing started (YES in step S2), it then determines whether an elapsed time t from the last printing exceeds a predetermined time or not. Specifically, it determines whether a condition of ((elapsed time t)>(predetermined time X)) is satisfied or not (step S4). Predetermined time X has been set to an appropriate value in view of image quality.

When it is determined that the condition of ((elapsed time t)>(predetermined time X)) is satisfied (YES in step S4), the process proceeds to a next step S6.

Conversely, when it is determined that the condition of ((elapsed time t)>(predetermined time X)) is not satisfied (NO in step S4), the process proceeds to a step S12.

In step S6, it is then determined whether a number M of last printed sheets is smaller than a predetermined value or not. Specifically, when it is determined that the condition of ((number M of printed sheets)<(predetermined number Y)) is satisfied (YES in step S6), the rotation of the heat-insulating rotation rollers is turned on. Thus, a forced drive mode is set. Then, the process proceeds to step S12. Predetermined number Y has been set to an appropriate value in view of the image quality.

When elapsed time t from the last printing is equal to or larger than the predetermined time, and number M of the last printed sheets is smaller than the predetermined value, the forced drive mode is selected to turn on the rotation of the heat-insulating rotation rollers.

Specifically, as described with reference to FIG. 13A, the drive is transmitted through gears G0-G5 to rotate heat-insulating rotation roller 46. Thereby, heat-insulating rotation rollers 46 and 48 rotate to suppress the temperature difference that may occur between regions 200 and 202 of heat-insulating rotation rollers 46 and 48.

Then, it is determined whether the forward end of the recording paper passed over the transfer roller or not (step S12). Specifically, it is determined whether document sensor 107 for sensing the document as described with reference to FIG. 1 sensed the passing of the forward end of the recording paper or not.

When it is determined in step S12 that the forward end of the recording paper passed over the transfer roller (YES in step S12), the process proceeds to a step S13. Conversely, when it is determined in step S12 that the forward end of the recording paper has not passed over the transfer roller (NO in step S12), the state in step S12 is maintained.

In step S13, it is determined whether the rotation of the heat-insulating rotation rollers is on or not. When the rotation of the heat-insulating rotation rollers is on (YES in step S13), the rotation of the heat-insulating rotation rollers is set off. Then, the process proceeds to a next step S16.

This example is configured such that, even in the state where the drive of gears G0-G5 is not transmitted to heat-insulating rotation rollers 46 and 48, heat-insulating rotation rollers 46 and 48 are rotated according to the transporting force applied by heating and pressing rollers 22 and 20 when the forward end of the recording paper passes through the nip region of heat-insulating rotation rollers 46 and 48.

Conversely, in step S13, when the rotation of the heat-insulating rotation rollers is not on, i.e., is off, the process proceeds to step S16.

Then, it is determined whether the rear end of the recording paper passed through fixing device 110 or not (step S16). Specifically, it is determined based on whether document sensor 109 for sensing the document as described with reference to FIG. 1 sensed the passing of the rear end of the recording paper or not.

When it is determined in step S16 that the rear end of the recording paper has not passed through fixing device 110P (NO in step S16), the current state is maintained.

Conversely, when it is determined in step S16 that the rear end of the recording paper passed through fixing device 110P (YES in step S16), it is determined whether an internal temperature of fixing device 110P is normal or not (i.e., is in an overheated state or not) (step S18). Specifically, temperature sensing unit 27 is used for determining whether the internal temperature of fixing device 110P is normal or not.

When it is determined in a step S18 that the internal temperature of fixing device 110P is not normal (i.e., it is overheated) (NO in step S18), the reverse rotation of the heat-insulating rotation rollers is turned on (step S20). Thus, the forced cooling mode is set. Then, the process returns to step S18. Specifically, as illustrated in FIG. 13B, the drive is transmitted using gears G0, G1 and G3-G5 to rotate reversely heat-insulating rotation roller 46. The reverse rotation guides the air flow from the exterior of fixing device 110P to the interior. Thereby, the inner temperature of fixing device 110P can be lowered.

Again, it is determined whether the inner temperature of fixing device 110P is normal or not. The reverse rotation of the heat-insulating rotation rollers continues until the internal temperature becomes normal.

Conversely, when it is determined that the inner temperature of fixing device 110P is normal (YES in step S18), it is determined whether the reverse rotation of the heat-insulating rotation rollers is on or not (step S21). When the reverse rotation of the heat-insulating rotation rollers is on (YES in step S21), the reverse rotation of the heat-insulating rotation rollers is turned off (step S22). Then, the process returns to step S2, and the similar processing will be repeated.

When the reverse rotation of the heat-insulating rotation rollers is not on, i.e., is off in step S21, the process returns to step S2, and the similar processing will be repeated.

In the configuration according to the first modification of the second embodiment of the invention, when time t elapsed since the last printing is equal to or shorter than the predetermined time, or when number M of the last printed sheets is equal to or larger than the predetermined value, there is high possibility that the surface temperature of the heat-insulating rotation rollers has been uniformized so that the heat-insulating rotation rollers do not rotate, and the electric power consumption is reduced.

Conversely, when time t elapsed since the last printing exceeds the predetermined time, and when number M of the last printed sheets is smaller than the predetermined value, it is considered that a large difference may be present in surface temperature of the heat-insulating rotation roller between regions 200 and 202. Therefore, the heat-insulating rotation rollers are rotated to uniformize the surface temperatures so that the image noises such as irregularities in gloss can be suppressed to keep high image quality.

When the inner temperature of fixing device 110P is excessively high, the heat-insulating rotation rollers are reversely rotated so that the external air is supplied into fixing device 110P to suppress rising of the inner temperature of fixing device 110P.

This example has been described in connection with the configuration that turns off the rotation of heat-insulating rotation roller 46 to stop drive transmission via the gears when the recording paper passes through fixing device 110P. However, for the purpose of assisting the transporting force applied from heating and pressing rollers 22 and 20 to the recording paper in the normal drive mode other than the forced drive mode, the rotation of heat-insulating rotation roller 46 may be turned on to cause the rotation via the gears. When the sheet does not pass, the number of effective gears may be changed to turn on the reverse rotation of heat-insulating rotation roller 46 so that the reverse rotation via the gears can be performed.

(Second Modification of the Second Embodiment)

Figure 15:
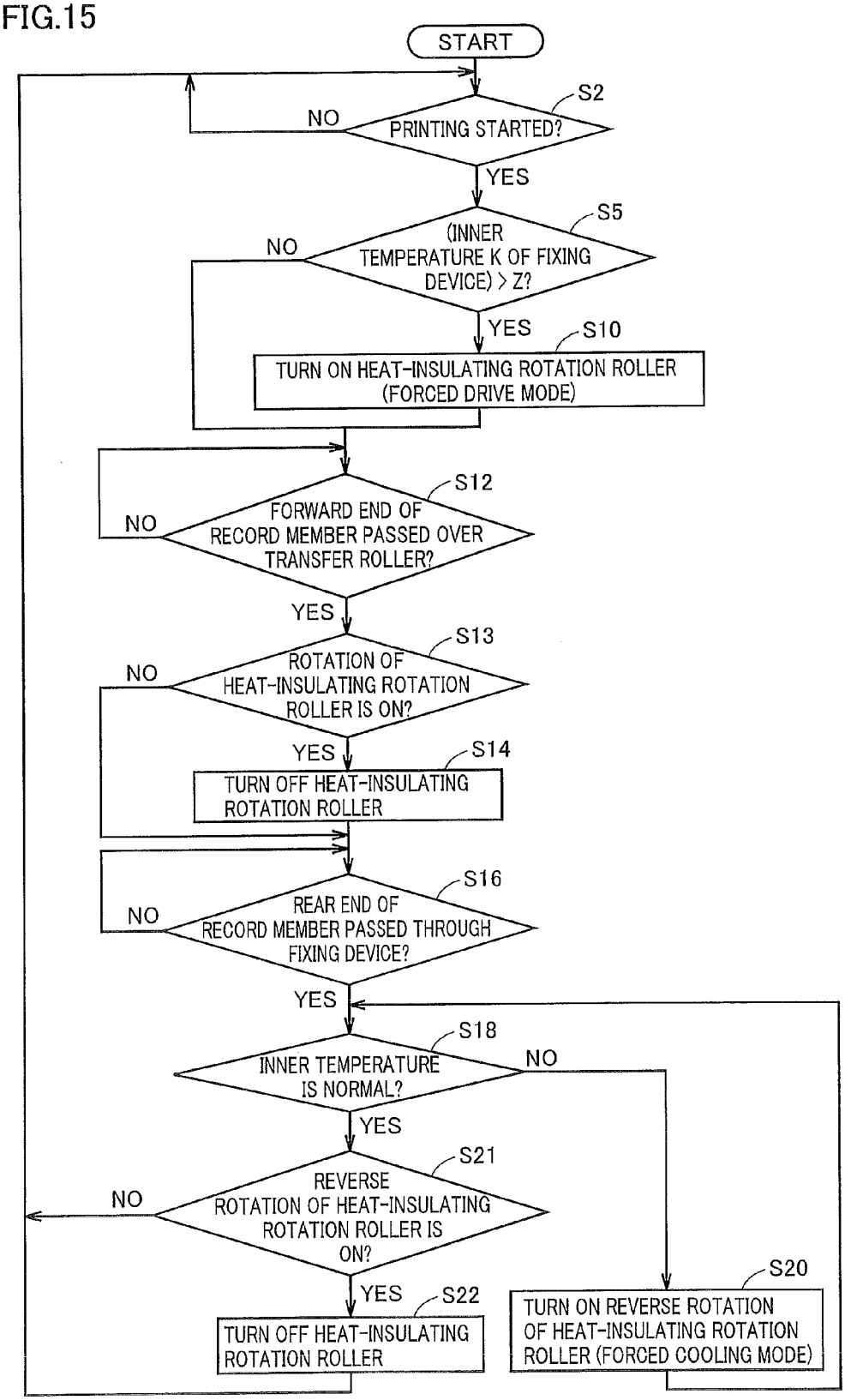
FIG. 15 is a flowchart illustrating the drive sequence of heat-insulating rotation roller 46 according to a second modification of the second embodiment of the invention.

FIG. 15 is a flowchart illustrating the drive sequence of heat-insulating rotation roller 46 according to a second modification of the second embodiment of the invention.

This drive sequence is implemented by controller 10 reading a software program stored in memory 12.

Referring to FIG. 15, the drive sequence differs from that in FIG. 14 in that a step S5 is employed in place of steps S4 and S6.

Others are the same, and therefore description thereof is not repeated.

When it is determined that the printing starts (YES in step S2), it is then determined whether an inner temperature K of fixing device 110P exceeds a predetermined temperature Z or not (step S5).

Specifically, temperature sensing unit 27 is used to sense inner temperature K of fixing device 110P. It is determined whether a condition of ((temperature K)>(predetermined temperature Z)) is satisfied or not. Predetermined temperature Z has been appropriately determined in view of image quality.

When it is determined in step S5 that the condition of ((temperature K)>(predetermined temperature Z)) is satisfied (YES in step S5), the process proceeds to a step S10, and the rotation of the heat-insulating rotation rollers is turned on. Thus, the forced drive mode is set. Then, the process proceeds to step S12.

When inner temperature K of fixing device 110P exceeds predetermined temperature Z, the forced drive mode is selected to turn on the rotation of the heat-insulating rotation rollers.

Specifically, as shown in FIG. 13A, gears G0-G5 are used to transmit the drive, and thereby to rotate heat-insulating rotation roller 46. Thereby, heat-insulating rotation rollers 46 and 48 rotate to suppress the temperature difference that may occur between regions 200 and 202 of heat-insulating rotation rollers 46 and 48 as already described.

Conversely, when it is determined in step S5 that the condition of ((temperature K)>predetermined temperature Z)) is not satisfied (NO in step S5), the process proceeds to next step S12.

The subsequent processing is substantially the same as that described with reference to FIG. 14, and therefore description thereof is not repeated.

In the configuration according to the second modification of the second embodiment of the invention, when inner temperature K of fixing device 110P is equal to or lower than predetermined temperature Z, it is considered that a significant temperature difference is not present in surface temperature between regions 200 and 202 of the heat-insulating rotation rollers. Therefore, a mode of reducing the power consumption without rotating the heat-insulating rotation roller is employed.

Conversely, when inner temperature K of fixing device 110P exceeds predetermined temperature Z, it is considered that a large temperature difference in surface temperature of the heat-insulating rotation rollers may be present between regions 200 and 202. Therefore, the heat-insulating rotation rollers rotate to uniformize the surface temperature so that the image noises such as irregularities in gloss can be suppressed and the good image quality can be kept.

When the inner temperature of fixing device 110P is excessively high, the heat-insulating rotation rollers reversely rotate to supply the external air into fixing device 110P so that the rising of the inner temperature of fixing device 110P can be suppressed.

This example has been described in connection with the configuration that turns off the rotation of heat-insulating rotation roller 46 to stop the drive transmission via the gears when the recording paper passes through fixing device 110P. However, for the purpose of assisting the transporting force applied from heating and pressing rollers 22 and 20 to the recording paper in the normal drive mode other than the forced drive mode, the rotation of heat-insulating rotation roller 46 may be turned on to cause the rotation via the gears.

(Third Modification of the Second Embodiment)

Figure 16:
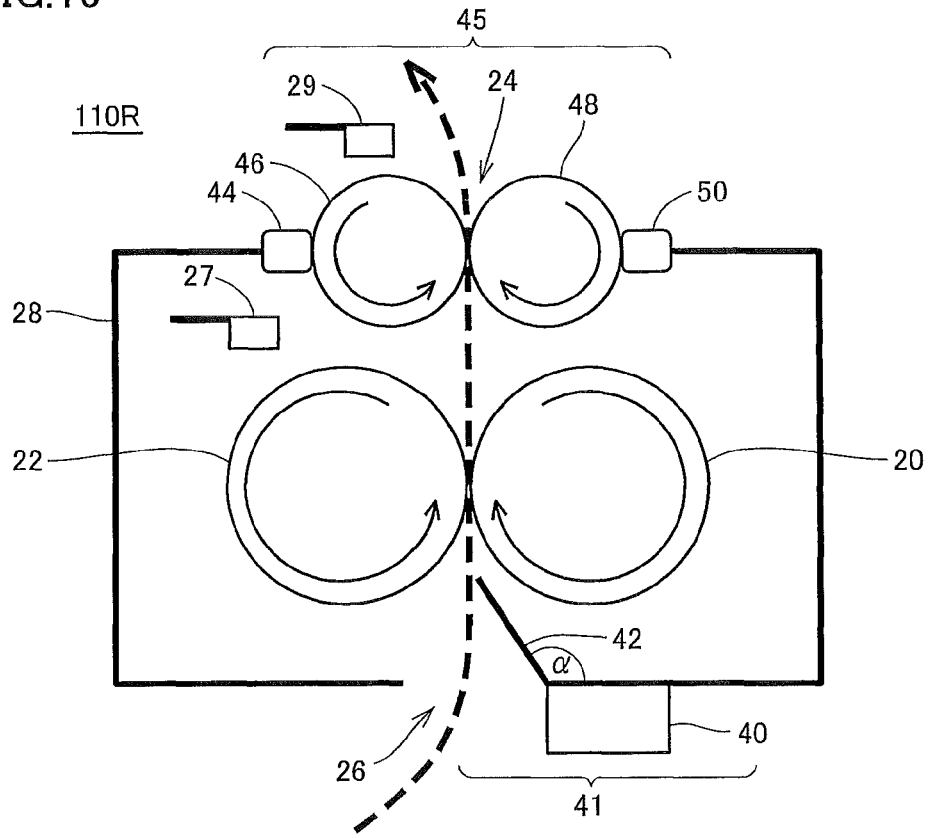
FIG. 16 is a cross section of a fixing device 110R according to a third modification of the second embodiment of the invention.

FIG. 16 is a cross section of a fixing device 110R according to a third modification of the second embodiment of the invention.

Referring to FIG. 16, fixing device 110R differs from fixing device 110P in that fixing device 110R includes, in addition to temperature sensing unit 27, temperature sensing unit 29 for sensing the surface temperature of region 200 of heat-insulating rotation roller 46 or 48. Others are substantially the same, and therefore description thereof is not repeated.

Figure 17:
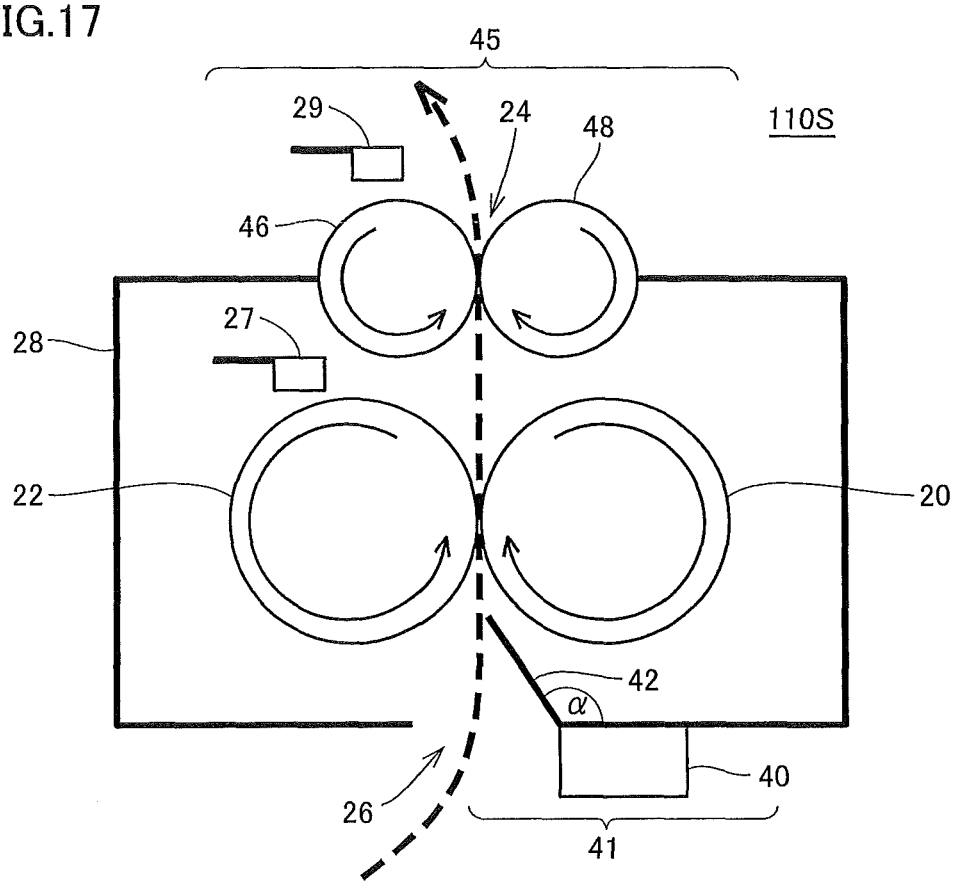
FIG. 17 is a cross section of a fixing device 110S according to the third modification of the second embodiment of the invention.

FIG. 17 is a cross section of a fixing device 1105 according to the third modification of the second embodiment of the invention.

As shown in FIG. 17, closing mechanism 45 may have a structure in which heat insulators 44 and 50 may be eliminated.

Figure 18:
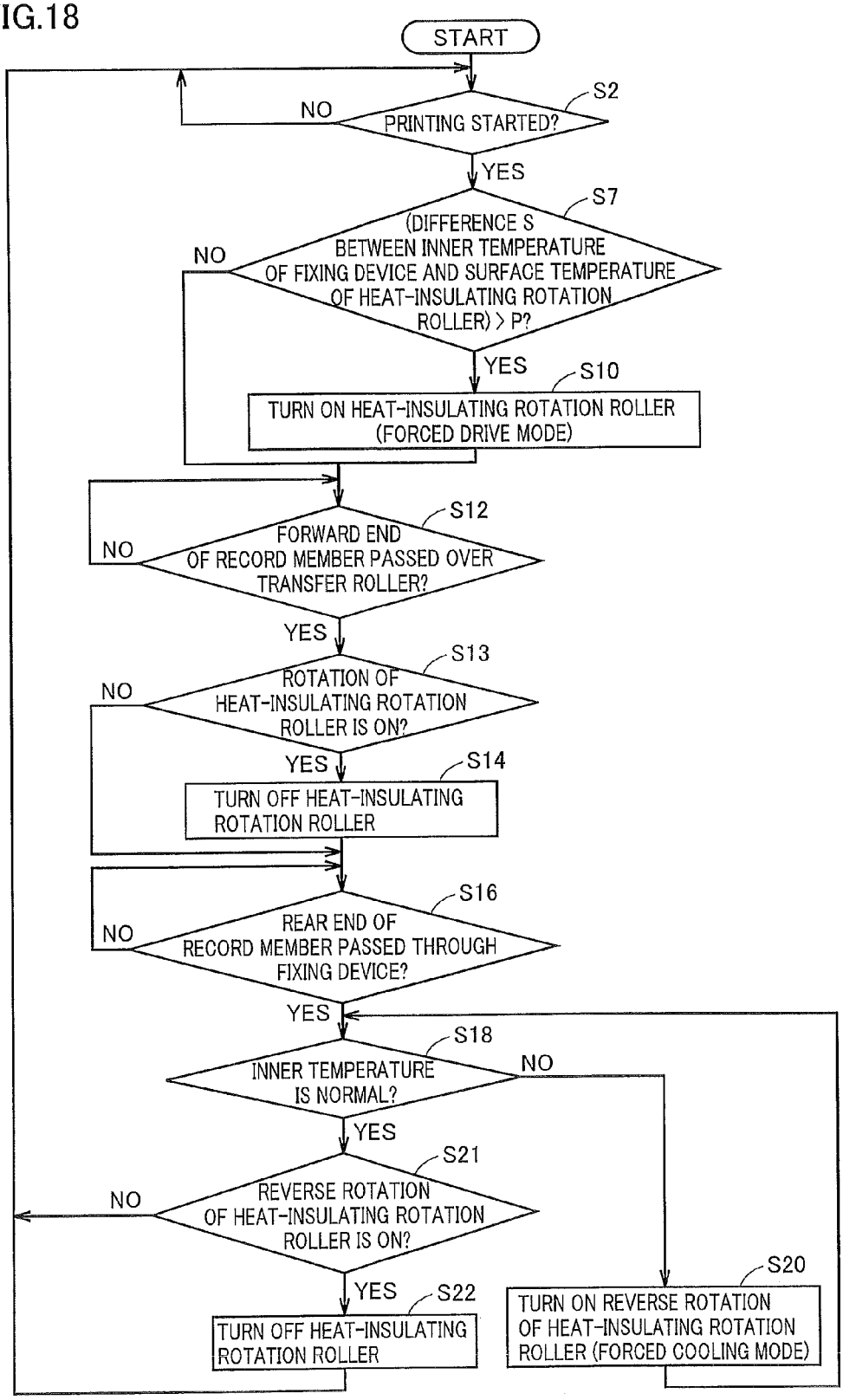
FIG. 18 is a flowchart illustrating a drive sequence of heat-insulating rotation roller 46 according to the third modification of the second embodiment of the invention.

FIG. 18 is a flowchart illustrating a drive sequence of heat-insulating rotation roller 46 according to the third modification of the second embodiment of the invention.

This drive sequence is implemented by the control means, i.e., controller 10 reading the software program stored in memory 12.

Referring to FIG. 18, steps S4 and S6 are replace with a step S7 in contrast to that shown in FIG. 14.

Others are substantially the same, and therefore description thereof is not repeated.

When it is determined that the printing started (YES in step S2), it is then determined whether a difference S between the inner temperature of fixing device 110R and the surface temperature of the heat-insulating rotation roller exceeds a predetermined value P or not (step S7).

Specifically, temperature sensing unit 27 is used to sense the inner temperature of fixing device 110R, Temperature sensing unit 29 senses the surface temperature of region 200 of heat-insulating rotation roller 46. By calculating difference S between them, it is determined whether the condition of ((difference S)>(predetermined value P)) is satisfied or not. Predetermined value P has been appropriately set in view of the image quality.

When it is determined in step S7 that the condition of ((difference S)>(predetermined value P)) is satisfied (YES in step S7), the process proceeds to next step S10, and the rotation of the heat-insulating rotation rollers is turned on. Thus, the forced drive mode is set. Then, the process proceeds to next step S12.

When difference S between the inner temperature of fixing device 110R and the surface temperature of the heat-insulating rotation rollers exceeds predetermined value P, the forced drive mode is selected, and the rotation of the heat-insulating rotation rollers is turned on.

Specifically, as shown in FIG. 13A, gears G0-G5 are used to transmit the drive, and thereby to rotate heat-insulating rotation roller 46. Thereby, heat-insulating rotation rollers 46 and 48 rotate to suppress the temperature difference that may occur between regions 200 and 202 of heat-insulating rotation rollers 46 and 48 as already described.

Conversely, when it is determined in step S7 that the condition of ((difference S)>predetermined value P)) is not satisfied (NO in step S7), the process proceeds to next step S12.

The subsequent processing is substantially the same as that described with reference to FIG. 14, and therefore description thereof is not repeated.

In the configuration according to the third modification of the second embodiment of the invention, when difference S between the inner temperature of fixing device 110R and the surface temperature of the heat-insulating rotation roller is equal to or smaller than predetermined value P, it is considered that a significant temperature difference is not present in surface temperature between regions 200 and 202 of the heat-insulating rotation rollers. Therefore, a mode of reducing the power consumption without rotating the heat-insulating rotation roller is employed.

Conversely, when difference S between the inner temperature of fixing device 110R and the surface temperature of the heat-insulating rotation roller exceeds predetermined value P, it is considered that a large temperature difference may be present in surface temperature of the heat-insulating rotation rollers between regions 200 and 202. Therefore, the heat-insulating rotation rollers rotate to uniformize the surface temperature so that the image noises such as irregularities in gloss can be suppressed and the good image quality can be kept.

When the inner temperature of fixing device 110R is excessively high, the heat-insulating rotation rollers reversely rotate to supply the external air into fixing device 110R so that the rising of the inner temperature of fixing device 110R can be suppressed.

This example has been described in connection with the configuration that turns off the rotation of heat-insulating rotation roller 46 to stop drive transmission via the gears when the recording paper passes through fixing device 110R. However, for the purpose of assisting the transporting force applied from heating and pressing rollers 22 and 20 to the recording paper in the normal drive mode other than the forced drive mode, the rotation of heat-insulating rotation roller 46 may be turned on to cause the rotation via the gears.

Third Embodiment

The second embodiment has been described in connection with the configuration uniformizing the surface temperatures by rotating heat-insulating rotation rollers 46 and 48 for suppressing the temperature difference that may occur between regions 200 and 202 of heat-insulating rotation rollers 46 and 48 during the warm-up, standby and the like.

However, when the surface temperature of heat-insulating rotation rollers 46 and 48 is low because only a short time elapsed since the start of printing, the quantity of heat applied to the recording paper is different from the quantity of heat that is applied to the recording paper when the surface temperature of heat-insulating rotation rollers 46 and 48 is high because the printing continued for a long time. In this case, variations occur in quantity of melted toner, and the gloss of the image changes.

A third embodiment will be described in connection with the configuration that performs control to prevent supplying of an excessive quantity of heat to the recording paper add thereby to suppress the variations in gloss due to the number of printed sheets for keeping good image quality.

The fixing device according to the third embodiment of the invention uses devices that are substantially the same as fixing devices 110R and 110S already described in connection with the second embodiment.

Figure 19:
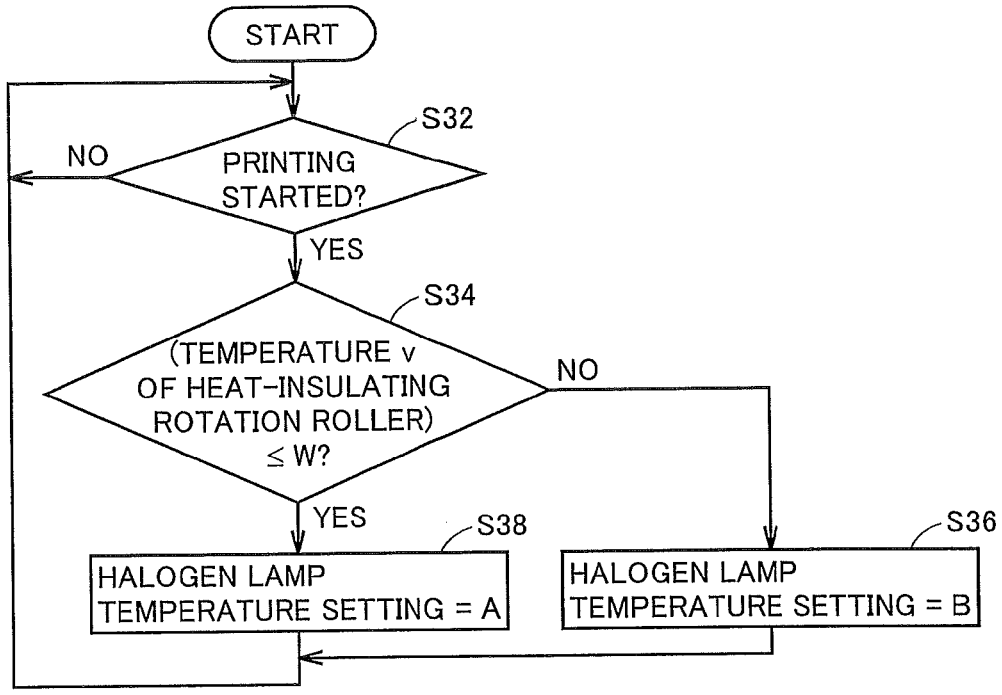
FIG. 19 is a flowchart illustrating temperature control of a halogen lamp according to a third embodiment of the invention.

FIG. 19 is a flowchart illustrating temperature control of a halogen lamp according to the third embodiment of the invention.

The temperature control is implemented by controller 10 reading a software program stored in memory 12.

Referring to FIG. 19, controller 10 first determines whether the printing started or not (step S32). Specifically, it determines whether a command of printing is received or not?

When it is determined that the printing started (YES in step S32), it is determined whether a temperature v of the heat-insulating rotation rollers satisfies a predetermined condition or not. Specifically, it is determined whether the condition of ((temperature v)≤(predetermined temperature W)) is satisfied or not (step S34). Predetermined temperature W has been set to an appropriate value in view of the image quality.

When it is determined in a step S34 that the condition of ((temperature v)≤(predetermined temperature W)) is satisfied (YES in step S34), the temperature of the halogen lamp is set to a temperature A (step S38). Then, the process returns to step S32. For example, temperature A is 180° C.

Conversely, when it is determined in step S34 that the condition of ((temperature v)≤(predetermined temperature W)) is not satisfied (NO in step S34), the temperature of the halogen lamp is set to a temperature B (step S36).

Then, the process returns to step S32. Temperature B satisfies ((temperature B)<(temperature A)), and is, e.g., 150° C.

Figure 20:
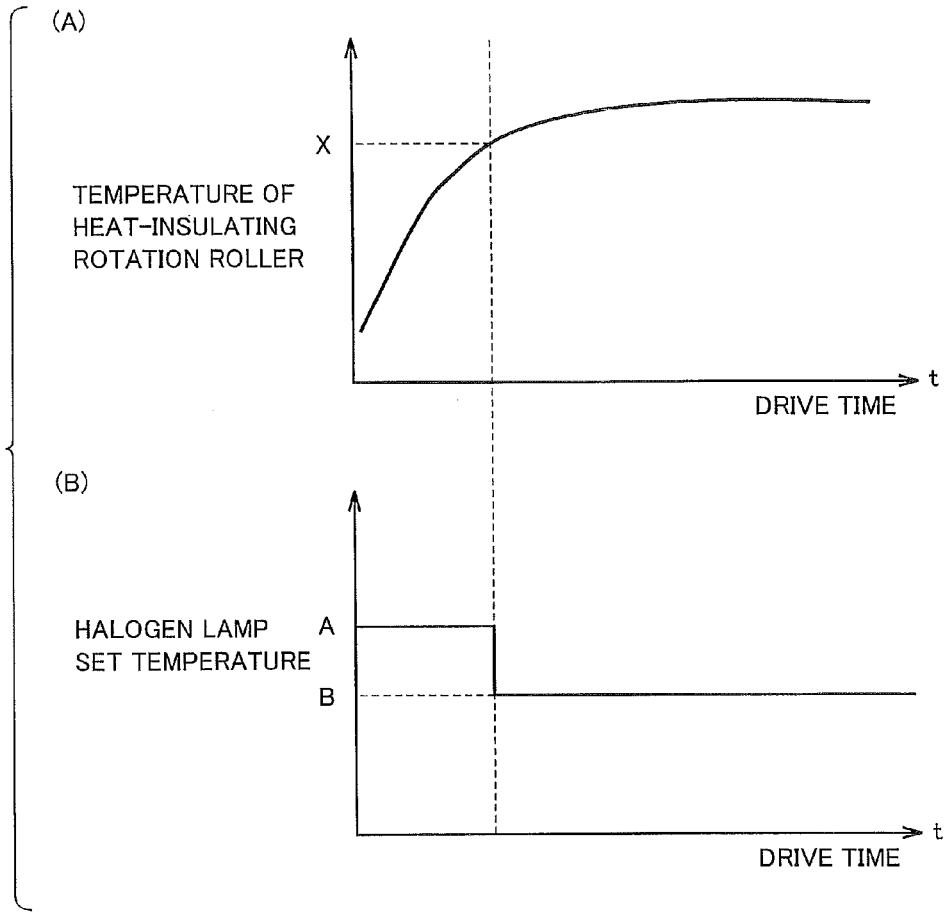
FIG. 20 is a view illustrating a relationship between a temperature of the heat-insulating rotation roller and a temperature of the halogen lamp according to the embodiment of the invention.

FIG. 20 illustrates a relationship between the temperature of the heat-insulating rotation roller and the temperature of the halogen lamp according to the embodiment of the invention.

Referring to FIG. 20(A), there is shown a case in which the temperature of the heat-insulating rotation roller gradually rises with the drive time.

Referring to FIG. 20(B), there is shown a case in which the setting of the temperature of the halogen lamp is changed when the temperature of the heat-insulating rotation roller rises above predetermined temperature W.

By this processing, the set temperature of the halogen lamp is set to a low temperature when the temperature of the heat-insulating rotation roller exceeds predetermined temperature W, and the set temperature of the halogen lamp is set to a normal temperature when the temperature of the heat-insulating rotation roller is equal to or lower than predetermined temperature W.

Thereby, the control is performed such that the quantity of heat supplied from the heating roller and the heat-insulating rotation rollers falls within a certain range and an excessive quantity of heat is not supplied.

Figure 21:
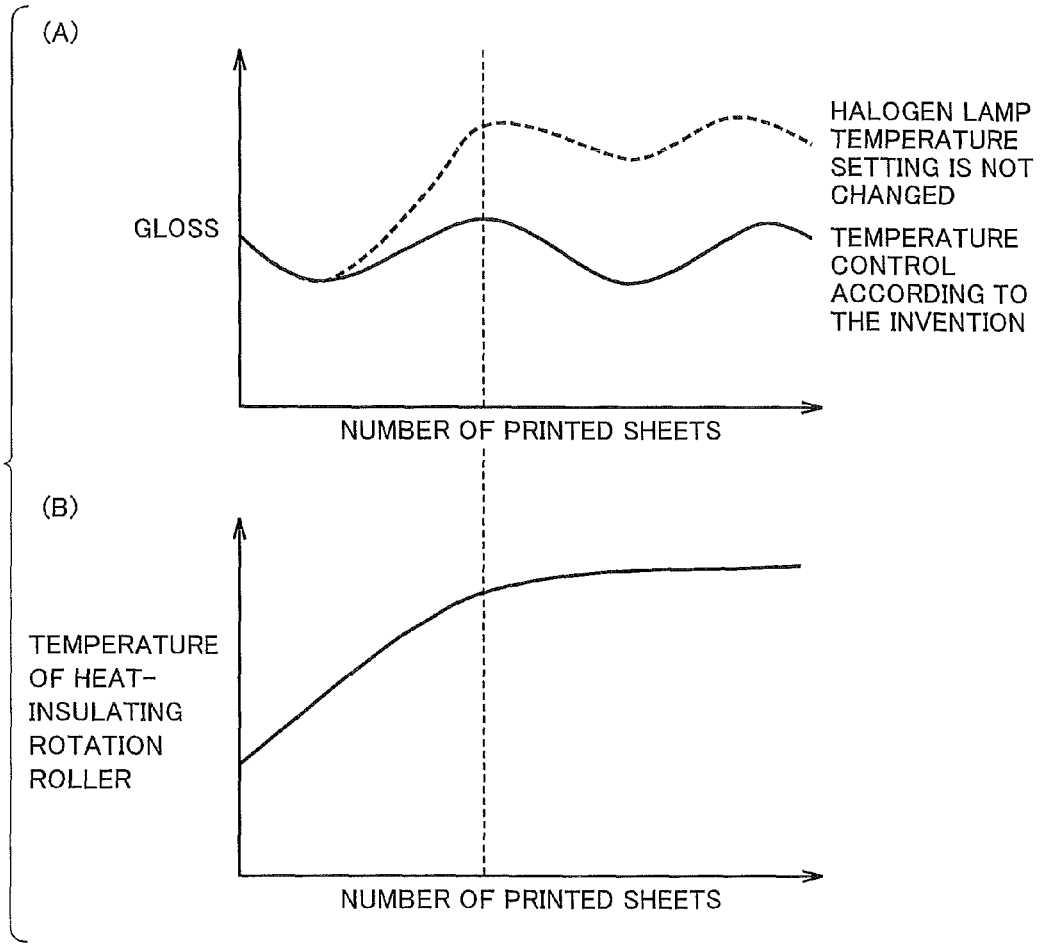
FIG. 21 is a view illustrating a relationship between the temperature of the heat-insulating rotation roller and a gloss of the recording paper according to the embodiment of the invention.

FIG. 21 illustrates a relationship between the temperature of the heat-insulating rotation roller and the gloss of the recording paper according to the embodiment of the invention.

Referring to FIG. 21(B), there is shown a case in which the temperature of the heat-insulating rotation roller gradually rises as the number of printed sheets increases, i.e., as the drive time increases.

Referring to FIG. 21(A), there is shown a case in which when the setting of the temperature of the halogen lamp does not change, the change in gloss of the recording paper occurring with the rising of the temperature of the heat-insulating rotation roller occurs to a higher extent as the number of the printed sheets increases, i.e., as the drive time increases as shown by dotted line, and further a large difference occurs in gloss of the recording paper between the time when only a short time elapsed since the start of the printing and the time when the printing has continued for a long time.

There is also shown a case of the embodiment of the invention that changes the setting of the temperature of the halogen lamp. In this case, even when the number of printed sheets increases, i.e., even when the drive time increases, the quantity of heat supplied to the recording paper is adjusted so that the gloss of the recording paper falls within a predetermined range, as indicated by solid line. Thus, the irregularities in gloss due to the number of printing can be suppressed to achieve the good image quality by suppressing the total quantity of heat applied to the recording paper to fall within the certain range.

Figure 22:
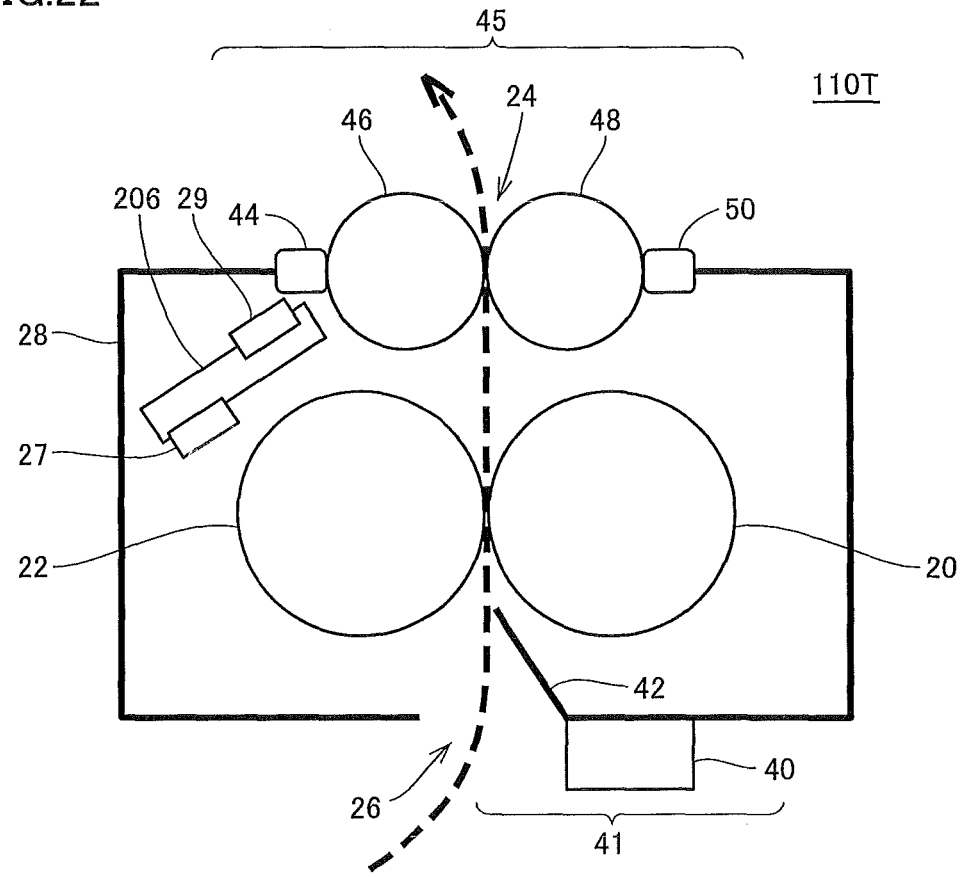
FIG. 22 is a view illustrating an arrangement of temperature sensing unit in a fixing device 110T according to a modification of the third embodiment of the invention.

FIG. 22 illustrates arrangement of the temperature sensing unit in a fixing device 110T according to a modification of the third embodiment of the invention.

Referring to FIG. 22, two kinds of temperature sensing units 27 and 29 for heating roller 22 and heat-insulating rotation roller 46 may be arranged on one heat-insulating base member 206 as shown therein, respectively. This can reduce a space required for sensing the temperatures of the heat-insulating rotation rollers and the heating roller.

Naturally, the fixing devices according to the second and third embodiments of the invention can employ the structures of the first to fourth modifications of the embodiment.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

a fixing device for fixing a toner image onto a recording paper including:

a heating member for heating said recording paper, a pressing member for pressing said heating member by pressure-applying contact, a casing including an interior accommodating said heating member and said pressing member, said casing being provided with an exit port for discharging said recording paper, and a closing unit added to said exit port for maintaining a temperature inside said casing, wherein said closing unit has:

(i) a rotation member having a surface possessing a first portion facing said interior of said casing and a second portion facing exteriorly of said casing, and (ii) an opposed member forming a nip region together with said rotation member; and a controller configured to:

obtain a value corresponding to a surface temperature of said surface on said rotation member;

determine whether a difference in surface temperature exists between said first and second portions of said rotation member by comparing the obtained value with a predetermined value; and uniformize a surface temperature of said rotation member by rotating said rotation member before passing of said recording paper when said determination portion determines that a difference in surface temperature exists between said first and second portions of said rotation member.

2. The fixing device according to claim 1, wherein said opposed member is an opposed rotation member.

3. The fixing device according to claim 1, wherein said opposed member is a partial region of the opposed casing.

4. The fixing device according to claim 1, wherein said rotation member is formed of a member having a heat-insulating property.

5. The fixing device according to claim 1, wherein said nip region formed between said rotation member and said opposed member is formed without any gap in a region other than said recording paper during sheet passing.

6. The fixing device according to claim 1, further comprising:

a different closing unit added to an entry port for keeping a temperature of said casing, wherein said different closing unit has:

a different rotation member for taking in said recording paper, and a different opposed member for forming a different nip region together with said different rotation member.

7. The fixing device according to claim 1, further comprising:

an openable shutter added to an entry port.

8. The fixing device according to claim 1, wherein said closing unit further has a heat-insulating member arranged between said casing and said rotation member.

9. The fixing device according to claim 1, wherein said rotation member rotates before the passing of said recording paper.

10. The fixing device according to claim 1, further comprising:

a drive unit for driving said rotation member, wherein said drive unit drives said rotation member before the passing of said recording paper according to an instruction based on a number of the last printed record papers and a time elapsed since last printing.

11. The fixing device according to claim 1, further comprising:

first temperature sensing unit for sensing a temperature in said casing, wherein a surface temperature of said rotation member is uniformized before the passing of said recording paper based on a result of sensing by said first temperature sensing unit.

12. The fixing device according to claim 11, further comprising:

second temperature sensing unit for sensing a temperature of said rotation member outside said casing, wherein the surface temperature of said rotation member is uniformized before the passing of said recording paper based on a difference between results of sensing by said first temperature sensing unit and said second temperature sensing unit.

13. The fixing device according to claim 11, wherein a rotation direction of said rotation member is changeable, and said rotation direction of said rotation member is changed based on the result of sensing by said first temperature sensing unit.

14. The fixing device according to claim 1, wherein a rotation direction of said rotation member is changeable.

15. The fixing device according to claim 1, further comprising:

a first drive transmission path for rotating and driving said rotation member in a first rotation direction; and a second drive transmission path for rotating and driving said rotation member in a second rotation direction, wherein change between said first and second drive transmission paths is performed according to a not-passing state and a passing state of said recording paper.

16. The fixing device according to claim 1, wherein said opposed member has a different rotation member for rotation together with said rotation member.

17. The fixing device according to claim 1, wherein a set temperature of said heating member is adjusted when a surface temperature of said rotation member is equal to or higher than a predetermined temperature.

18. The fixing device according to claim 17, further comprising:

first temperature sensing unit for sensing the temperature of said heating member; and second temperature sensing unit for sensing the temperature of said rotation member.

19. The fixing device according to claim 18, wherein said first temperature sensing unit and said second temperature sensing unit are located in said casing and are attached to one base member.

20. The fixing device according to claim 17, wherein the set temperature of said heating member is lowered when the surface temperature of said rotation member becomes equal to or higher than a predetermined temperature.

21. The fixing device according to claim 1, wherein the obtained value is at least one of a time that has elapsed since a last printing operation and a number of last printed sheets.

22. An image forming apparatus comprising:

image forming means for forming a toner image;

a fixing device for fixing said toner image onto a recording paper, wherein said fixing device includes:

a heating member for heating said recording paper, a pressing member for pressing said heating member by pressure-applying contact, a casing including an interior accommodating said heating member and said pressing member, said casing being provided with an exit port for discharging said recording paper, and a closing unit added to said exit port for maintaining a temperature inside said casing wherein said closing unit has:

(i) a rotation member having a surface possessing a first portion facing said interior of said casing and a second portion facing exteriorly of said casing, and (ii) an opposed member forming a nip region together with said rotation member; and a controller configured to:

obtain a value corresponding to a surface temperature of said surface on said rotation member;

determine whether a difference in surface temperature exists between said first and second portions of said rotation member by comparing the obtained value with a predetermined value and rotate said rotation member before said recording member passes through said nip region if a difference in surface temperature is determined to exist between said first and second portions of said rotation member.

* * * * *